United States Patent [19]

Caruso

[11] 4,333,073

[45] Jun. 1, 1982

[54] ELECTROMECHANICAL DECODER

[75] Inventor: Peter J. Caruso, Wayne, N.J.

[73] Assignee: The Bendix Corporation, Teterboro, N.J.

[21] Appl. No.: 371,072

[22] Filed: May 28, 1964

[51] Int. Cl.[3] ..... E05B 37/00; E05B 45/06

[52] U.S. Cl. ..... 340/825.36; 70/313; 70/278; 340/543

[58] Field of Search ..... 340/164, 365; 35/3, 35/4; 70/213, 214, 288, 297, 299, 313, 333

[56] References Cited

U.S. PATENT DOCUMENTS

| | | | |
|---|---|---|---|
| 436,597 | 9/1890 | Deal | 70/214 R |
| 2,855,588 | 10/1958 | Allen | 340/164 R X |
| 2,968,790 | 1/1961 | Carbonara | 340/164 A |
| 3,099,150 | 7/1963 | Check | 70/214 R X |
| 3,213,425 | 10/1965 | Stickel | 340/164 R |

*Primary Examiner*—David H. Brown

*Attorney, Agent, or Firm*—Anthony F. Cuoco; Vett Parsigian

[57] ABSTRACT

A mechanism comprising a code wheel assembly including a first element, a second element and a third element, a element, a plurality of main code posts preset for locking the first element and the second element in driving relation, selectively operable means for actuating the main code posts sequentially in a predetermined sense for unlocking the second and first elements, an auxiliary code post operable for locking the first element to the third element following the actuation of the main code posts sequentially in said predetermined sense to unlock the first and second elements, control means selectively actuated by the third element for performing a control function, and said control means being selectively actuated by said third element following the locking of the first element to the third element by the auxiliary code post and after the first element has been unlocked from the second element.

45 Claims, 9 Drawing Figures

ELECTROMECHANICAL DECODER

This invention relates to an electromechanical decoder of a type disclosed and claimed in copending U.S. applications for patent Ser. No. 306,792, filed Sept. 4, 1963; Ser. No. 328,083, filed Dec. 4, 1963; and Ser. No. 338,483, filed Jan. 17, 1964; all of which applications have been filed by Peter J. Caruso, the inventor of the present invention, and assigned to The Bendix Corporation, assignee of the present invention.

More particularly, the present invention relates to novel means to cyclically limit the operation of the electromechanical decoder for a predetermined time interval upon a predetermined number of unsuccessful attempts to operate the decoder mechanism indicative of unauthorized code deducing or tampering attempts by hostile personnel, and further the invention relates to a novel means for varying the code setting of the mechanism.

Another object of the invention is to provide a novel cyclically operable means for limiting the operation of the electromechanical decoder so as to prevent extensive exposure of the mechanism to code deducing or tampering attempts.

Another object of the invention is to provide a drive for the aforenoted device including a pair of solenoids so arranged that each time one of the solenoids is energized, a code wheel assembly is step actuated, while a series of code posts carried thereby are selectively actuated in locking and unlocking senses depending on the selection of the solenoid and the preset adjustment of each of the code posts, together with novel means whereby upon the selective operation of the step actuating solenoids so as to unlock the code wheel assembly, there is rendered effective novel means for transferring the control of one of the selectively actuated solenoids to a code change solenoid which is then rendered effective upon return of the code wheel assembly to a home position to selectively change the code setting of the code wheel assembly upon the selective operation of the other solenoid for step actuating the code wheel assembly.

Another object of the invention is to provide in an electromechanical decoder suitable means for applying a plurality of decoding bits which may be effective to cause the release of an inner wheel element from locking relation with an outer wheel element of the code wheel assembly, together with novel coupling means thereupon rendered effective to selectively couple the outer wheel element to one of a plurality of switch devices to render the same operable dependent upon a plurality of other control bits applied to the code wheel assembly.

Another object of the invention is to provide novel means in the aforenoted electromechanical decoder, whereby if any or all of the aforesaid decoding bits are improperly applied, the outer wheel element may remain locked to the inner wheel element so that the coupling means is thereupon rendered ineffective to provide the controlling operation of the switch devices.

Another object of the invention is to provide a drive for an electromechanical decoder including a pair of solenoids so arranged that each time one of the solenoids is selectively actuated, the code wheel assembly is step actuated while a series of code posts carried thereby are selectively actuated in locking or unlocking senses, dependent upon the selection of the solenoids by suitable operator-operative means and including a code change solenoid together with means to render the operator-operative means for one of the pair of solenoids effective to control the code change solenoid upon completion of the successful operation of the electromechanical decoder.

Another object of the invention is to provide an electromechanical decoder unit arranged to select a serially connected input and so arranged as not to interrogate each solenoid as received, but rather including means whereby the received code inputs may be stored and read out in parallel when the cycle unlocking code input is applied together with a novel remote code changing mechanism rendered effective upon the code input applied to the decoding unit being ineffective to unlock the unit.

Another object of the invention is to provide an electromechanical decoding unit including timer means to render the operating mechanism for the decoding unit ineffective for a predetermined interval of time upon a predetermined number of unsuccessful attempts to operate the decoder mechanism being registered as indicative of possible security violations by hostile personnel.

Another object of the invention is to provide an electromechanical decoder unit including novel cycle counting means for selectively effecting operation of a timer means for rendering the operating mechanism for the decoder unit ineffective over a preset period of time upon the termination of a predetermined number of unsuccessful cycles of operation.

These and other objects and features of the invention are pointed out in the following description in terms of the embodiments thereof which are shown in the accompanying drawings. It is to be understood, however, that the drawings are for the purpose of illustration only and are not a definition of the limits of the invention. Reference is to be had to the appended claims for this purpose.

In the drawings in which corresponding parts have been indicated by corresponding numerals:

Figure 1A:
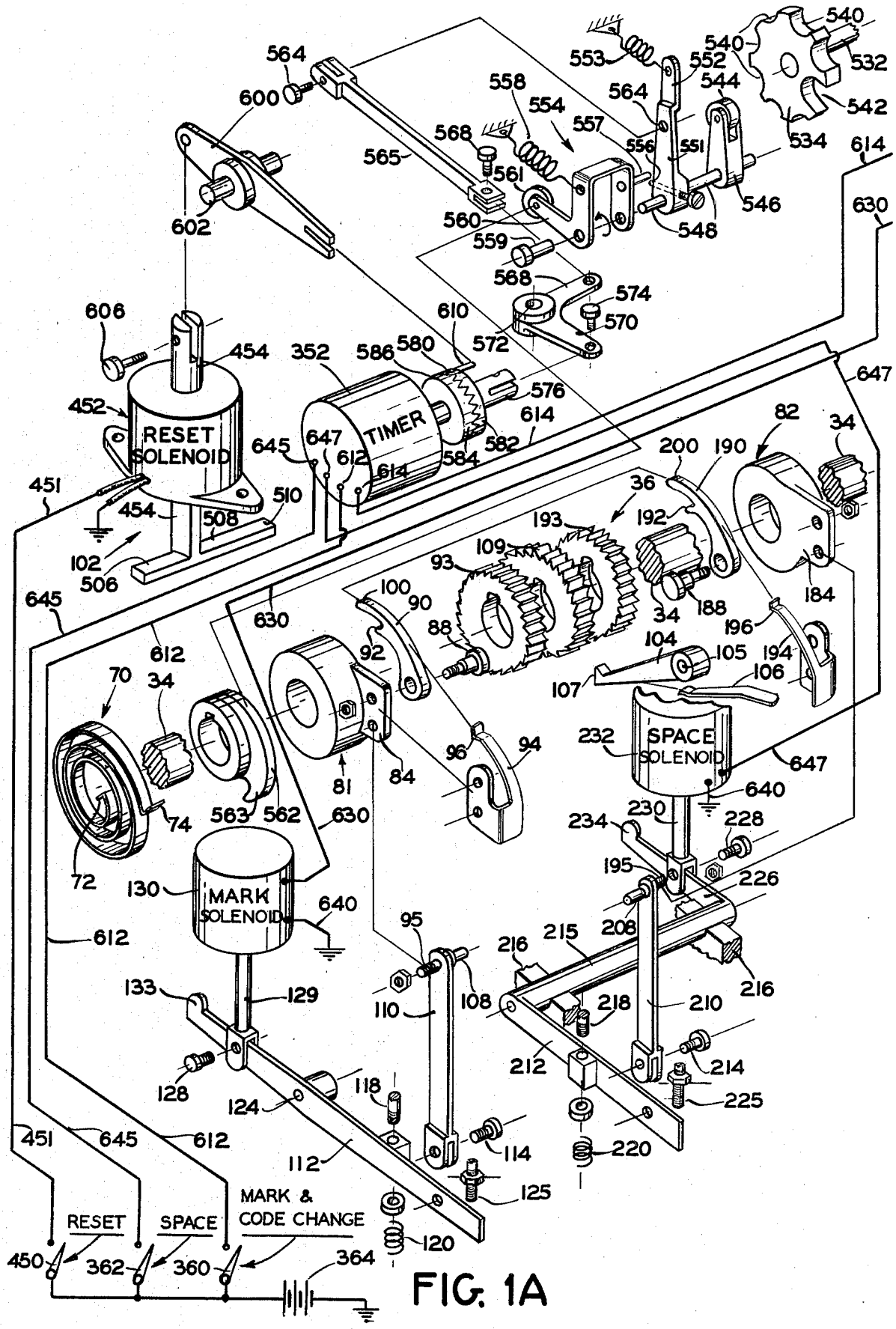
FIG. 1A is an exploded detail schematic diagram of that part of the electromechanical decoder including the step actuator and cooperating mechanism.
Figure 1B:
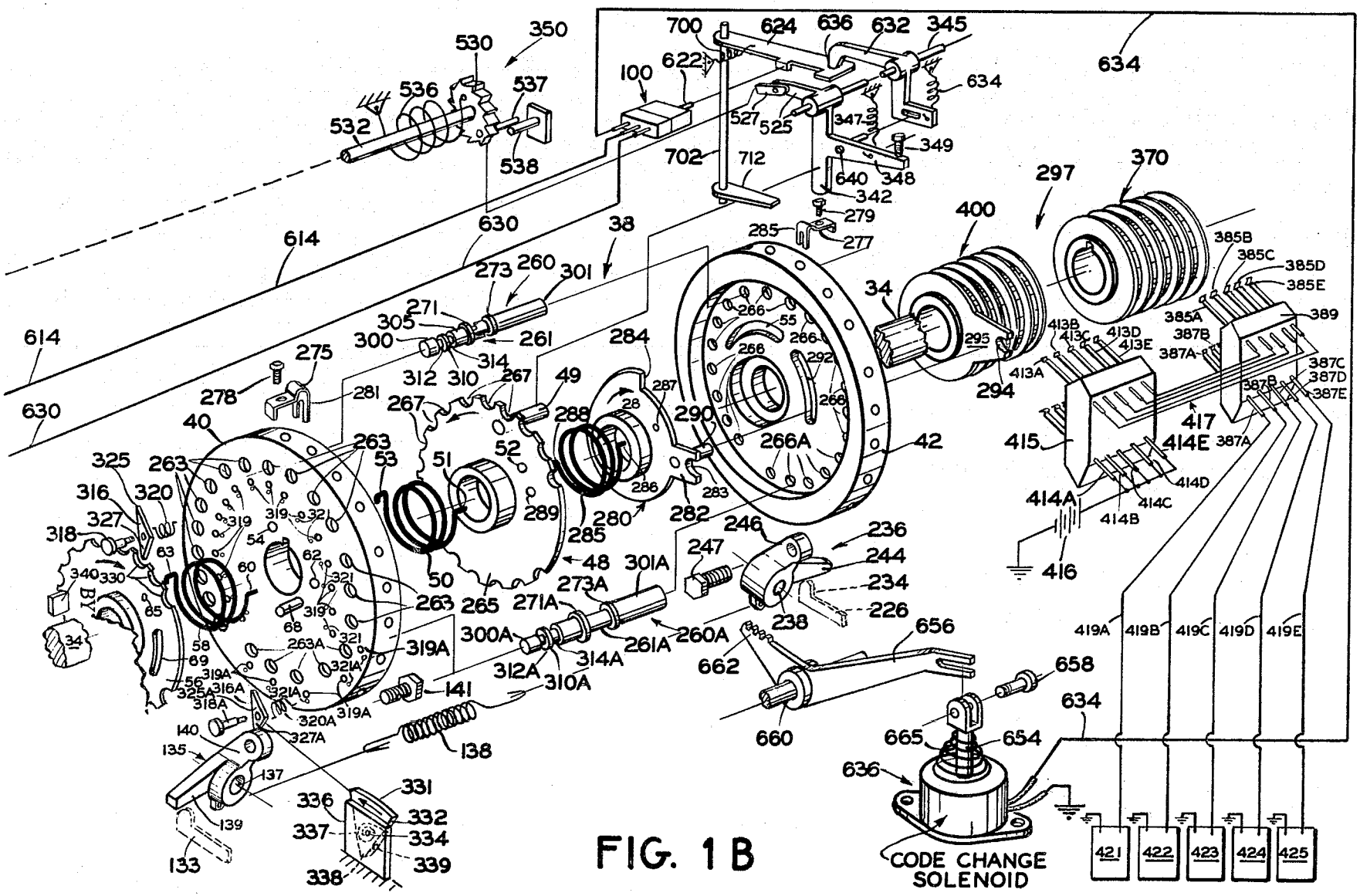
FIG. 1B is an exploded detail schematic diagram of the remaining part of the electromechanical decoder including the code wheel assembly and cooperating mechanism.
Figure 2:
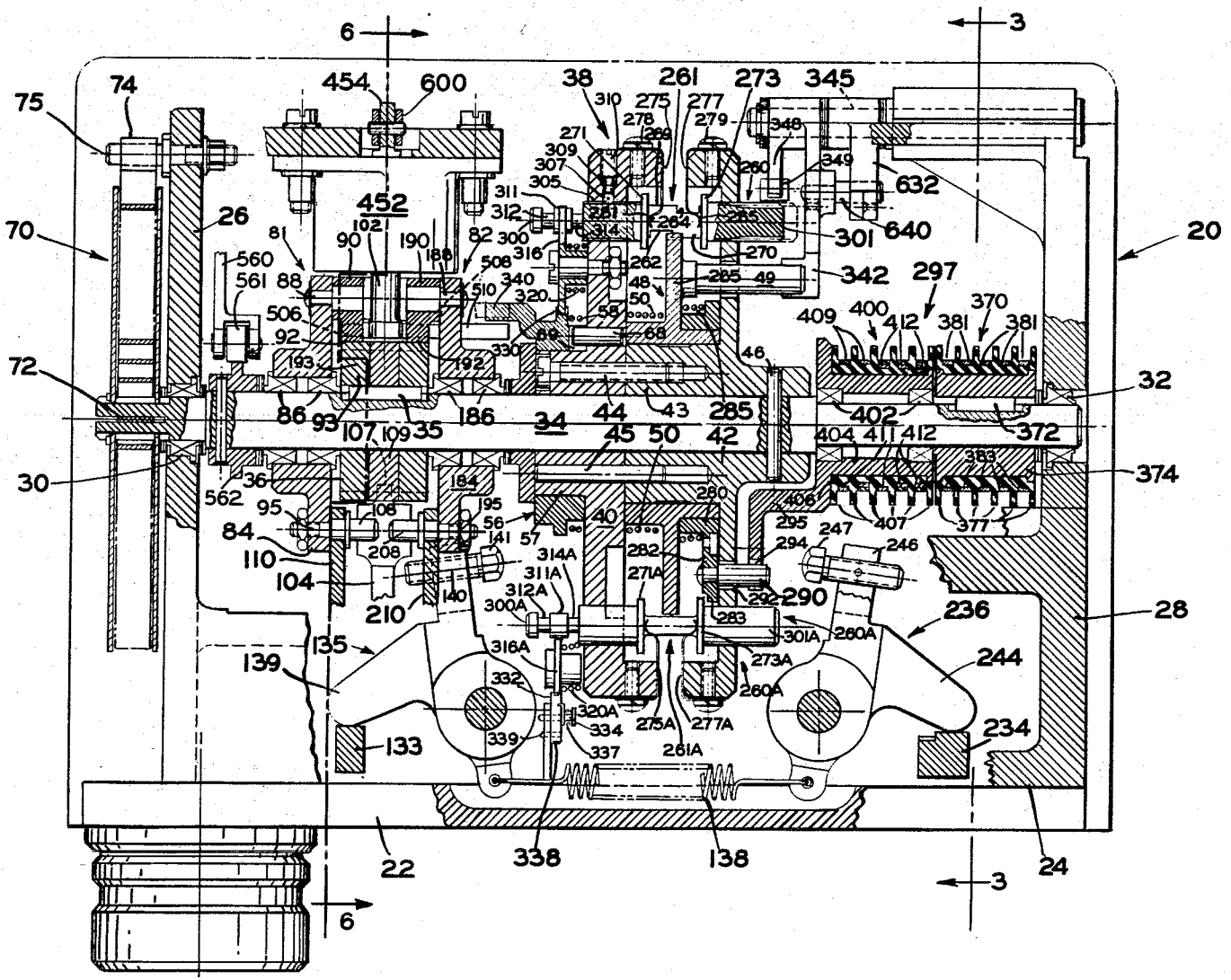
FIG. 2 is a sectional view of the assembled structure of the electromechanical decoder of FIGS. 1A and 1B illustrating one of the main and address type code posts in an operative relation in the code wheel assembly as well as showing the selector and qualifying rotary switches operatively controlled by the code wheel assembly.

Referring to the drawing of FIG. 2, a decoder mechanism is shown housed in a casing 20 having a base 22 to which may be fastened a bulkhead 24. There may project from the bulkhead 24 end portions 26 and 28 in which there may be rotatably mounted a shaft 34 on bearings 30 carried by the end portions 26 and bearings 32 carried by the end portion 28. The decoder shaft 34 has secured thereto by a key 35 a ratchet wheel 36, shown in FIGS. 1A, 2 and 6 and there is further secured to shaft 34 a code wheel assembly 38, shown in FIGS. 1B and 2, as hereinafter explained.

The code wheel assembly 38, as shown in FIGS. 1B and 2, includes outer wheel elements 40 and 42. The outer wheel element 42 has an annular bearing 43, as shown in FIG. 2, which is secured to the outer wheel element 40 by a bolt 44 and pin 45. The outer wheel elements 40 and 42 and bearing 43 are in turn secured to shaft 34 by a pin 46. Angularly movable on bearing 43 and within the outer wheel elements 40 and 42 is an inner wheel element 48 operatively connected to outer wheel element 40 by a light coupling spring 50 connected at one end 51 to the inner wheel element 48 at 52 and at the opposite end 53 at 54 to the outer wheel element 40. There projects from the inner wheel element 48 a pin 49 which is normally biased by the preload of the coupling spring 50 in an arcuate slot 55 provided in the outer wheel element 42 and in a counterclockwise direction corresponding to the direction of actuation of the ratchet wheel 36. Thus, in the form of the invention shown in FIGS. 1A, 1B, and 2, the inner wheel element 48 would be biased by the spring 50 in a counterclockwise direction and indicated by the arrow.

Further, as shown in FIG. 2, there is angularly movable on a bearing 57 projecting from the outer wheel element 40 a reset wheel 56 operatively connected to the outer wheel element 40 by a coupling spring 58 connected, as shown in FIG. 1B at one end 60 in a hole 62 in the outer wheel element 40 and connected at an opposite end 63 in a hole 65 formed in the reset wheel 56 so as to bias the reset wheel 56 in a direction opposite from that of the direction of actuation of the stepper wheel 36. Thus, as shown in FIG. 1B, the spring 58 biases the reset wheel 56 in a clockwise direction relative to the outer wheel element 40, as shown by the arrow on the reset wheel 56.

In the form of the invention shown schematically by FIGS. 1A and 1B, and structurally in FIG. 2, a pin 68 projects from the outer wheel element 40 into a slot 69 in the reset wheel 56. The slot 69 cooperates with the pin 68 to limit the clockwise movement of the reset wheel 56 under the biasing force of spring 58, as viewed in FIGS. 1B and 2.

There is further provided a spring 70, as shown in FIGS. 1A and 2, connected at one end at 72 to the shaft 34 and coiled about the shaft 34 and connected at the opposite end at 74 by a pin 75 projecting from the end portion 26 so as to be tensioned upon angular movement of the shaft 34 by a step action of pawls 90 and 190 so as to be effective to return the shaft 34 to a safe, home, or null position upon release of the actuating pawls, as hereinafter explained.

PAWL ACTUATING MECHANISM

Further, cooperating with the code wheel assembly 38, shown in FIG. 1B and adjustably positioned by the shaft 34 are pawl actuating mechanisms indicated generally by the numerals 81 and 82, as shown schematically in FIG. 1A and structurally in FIG. 2. The pawl actuating mechanism 81 includes a pawl supporting member 84 angularly movable on bearings 86 carried by the shaft 34. The pawl supporting member 84 has pivotally connected thereto by a pin 88 a pawl 90 having a tooth 92 biased into operating engagement with a toothed portion 93 of the ratchet wheel 36 by a leaf spring 94 secured to the supporting member 84 by the bolt 88 and a second bolt 95. The leaf spring 94 has an end portion 96 which bears upon the pawl 90 so as to bias the pawl 90 about the pin 88 in a counterclockwise direction, as shown schematically in FIG. 1A into cooperative relation with the toothed portion 93 of the ratchet wheel 36. The pawl 90 has an end portion 100 arranged to be operatively engaged by a pawl pick-up device 102, as shown in FIGS. 1A, 2 and 6.

Figure 6:
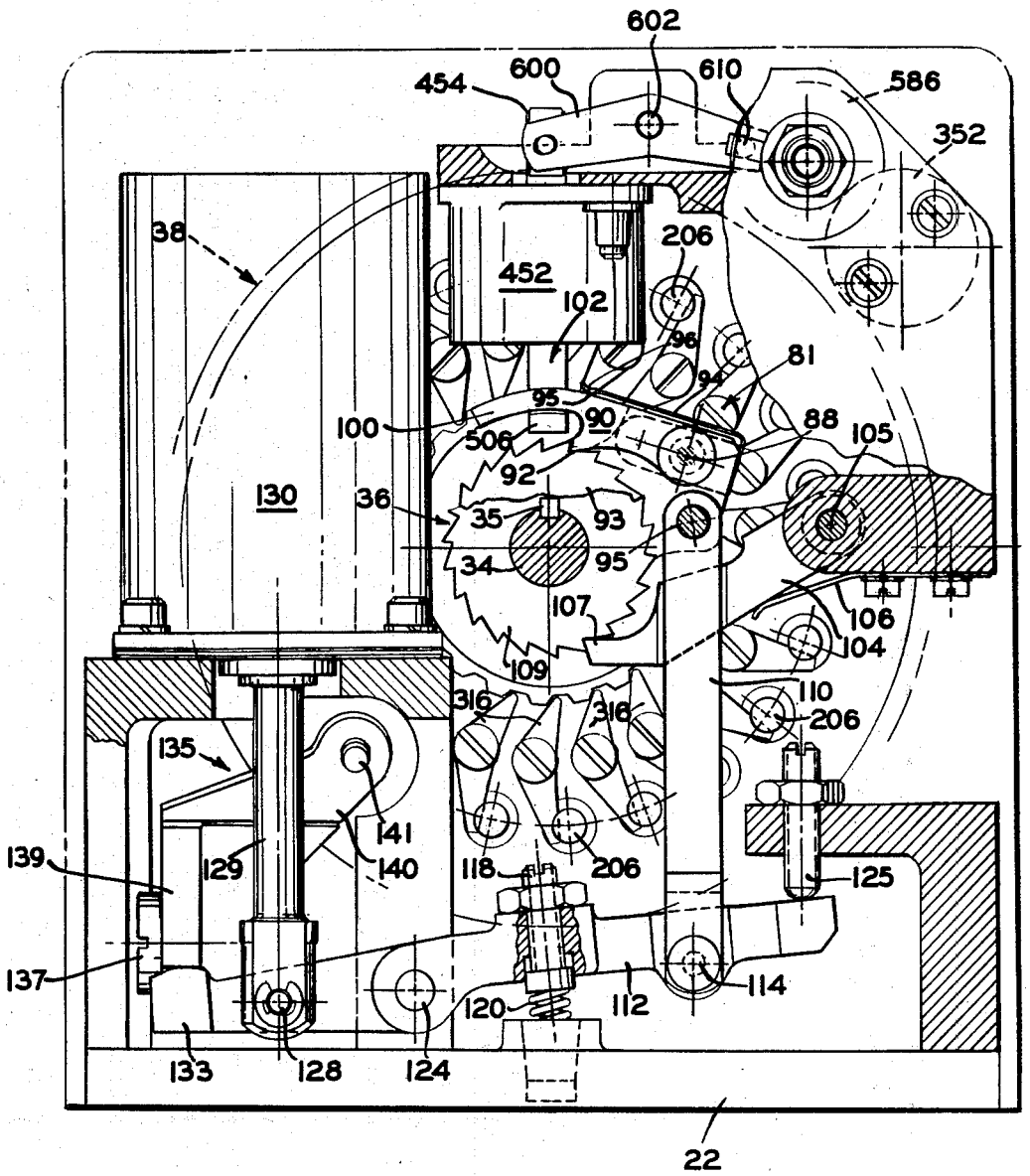
FIG. 6 is a sectional view of FIG. 2 taken along the lines 6—6 and looking in the direction of the arrows so as to show the operation of the reset solenoid actuating pawls and code posts locking mechanism at one end of the code wheel assembly.

The pawl 90 is arranged to step actuate the toothed portion 93 of the ratchet wheel 36 in a counterclockwise direction, as viewed in FIGS. 1A and 6, by the operation of the pawl supporting member 84.

The pawl supporting member 84 has operatively connected thereto by the pin 95 one end of an actuating linkage 110 operatively connected at an opposite end to an arm 112 through a pin 114 carried by the arm 112. A pin 118 screw threadedly engaged in the arm 112 projects from the arm 112 and is arranged so as to be operatively engaged by a spring 120 supported by the base plate 22. The arm 112 is pivotally supported by a pin 124 carried by a flange projecting from the base 22 and is biased by the spring 120 in a counterclockwise direction, as viewed in FIGS. 1A and 6, about the pin 124 into engaging relation with an adjustable stop pin 125.

The arm 112 is operatively connected by a pin 128 to an actuating rod 129 operatively positioned by a solenoid 130. The arm 112 has an end portion 133, shown schematically in FIG. 1A and in phantom in FIG. 1B and structurally in FIG. 6, and arranged to operatively engage a knocker arm 135 pivotally mounted on a pin 137 carried by a flange projecting from the base 22. The knocker arm 135 is biased by a spring 138 so as to maintain an end portion 139 thereof in operative engagement with the end portion 133 of the arm 112 while another end portion 140 of the knocker arm 135 has adjustably mounted thereon a knocker bolt 141 which upon energization of the solenoid 130 may be actuated into operative engagement with end portions 300 and 300A of the slidable main code posts 260 and address code posts 260A carried by the outer wheel elements 40 and 42 of the code wheel assembly 38 to longitudinally actuate the code posts in one sense to effect the selective operation thereof, as heretofore explained in the aforenoted application Ser. No. 306,792, filed Sept. 5, 1963, by Peter J. Caruso, and assigned to The Bendix Corporation.

Further, the pawl actuating mechanism 82, as shown in FIGS. 1A and 2, includes a pawl supporting member 184 angularly movable on bearings 186 carried by the shaft 34. The pawl supporting member 184 has pivotally connected thereto by a pin 188, a pawl 190 having a tooth 192 biased into operating engagement with a toothed portion 193 of the ratchet wheel 36 by a leaf spring 194, shown in FIGS. 1A, and secured to the supporting member 184 by the bolt 188. The leaf spring 194 has an end portion 196 which bears upon the pawl 190 so as to bias the pawl 190 about the pin 188 in a counterclockwise direction, as shown schematically in FIG. 1A into cooperative relation with the toothed portion 193 of the ratchet wheel 36. The pawl 190 has an end portion arranged to be operatively engaged by the pawl pick-up device 102, shown in FIGS. 1A, 2, and 6.

The pawl 190 is arranged to step actuate the toothed portion 193 of the ratchet wheel 36 in a counterclockwise direction, as viewed in FIGS. 1A and 6, by operation of the pawl supporting member 184.

The pawl supporting member 184 has operatively connected thereto by the pin 195 an end of an actuating linkage 210 operatively connected at an opposite end to an arm 212 through a pin 214 carried by the arm 212. The arm 212, as shown in FIGS. 1A and 3, is pivotally mounted at one end of shaft 215 rotatably supported by bearings in flanges 216 projecting from the base plate 22.

Figure 3:
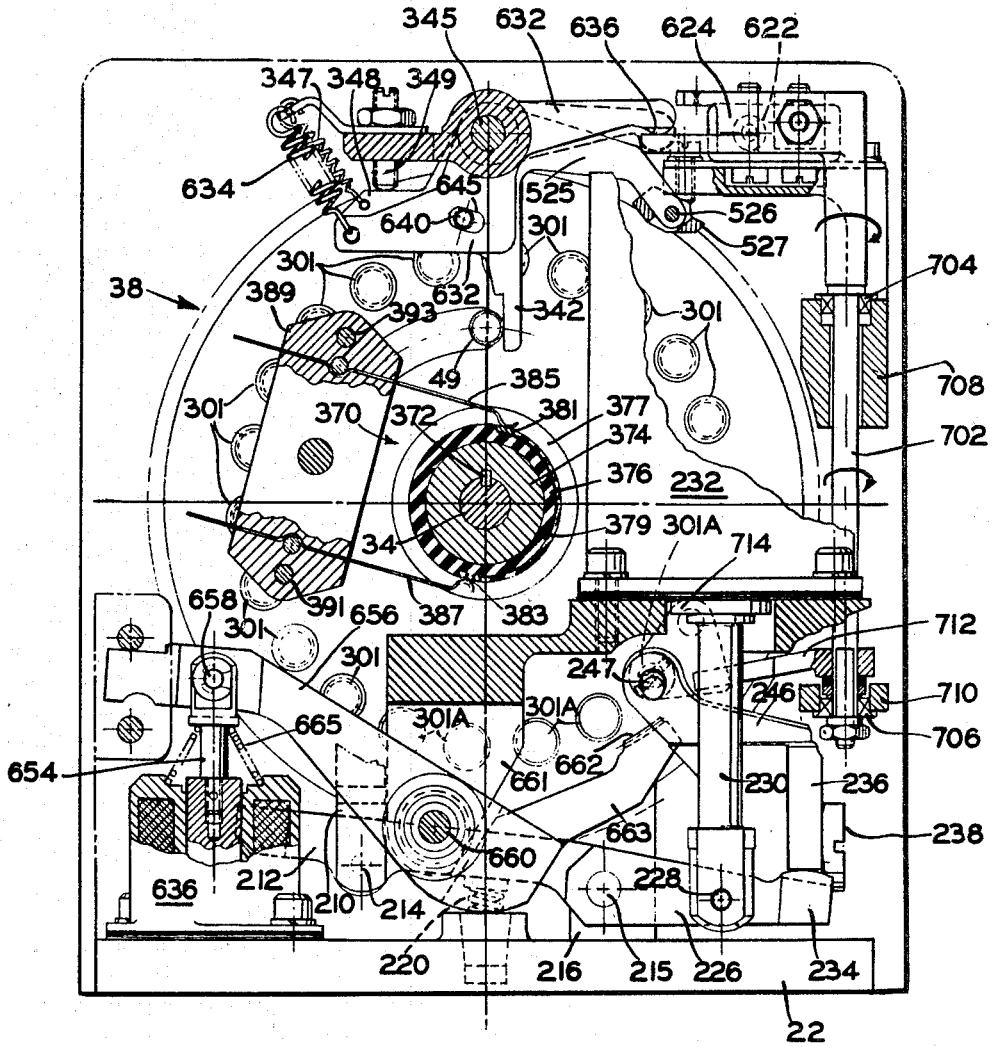
FIG. 3 is a sectional end view of the decoder of FIG. 2 taken along the lines 3—3 of FIG. 2 and looking in the direction of the arrows.

A pin 218 screw threadedly engage in the arm 212 projects from the arm 212 and is arranged so as to be operatively engaged by a spring 220 supported by the base plate 22 so that the arm 212 is biased by the spring 220 in a counterclockwise direction, as viewed in FIG. 1A and clockwise in FIG. 3, into engaging relation with an adjustable stop pin 225.

A second arm 226 mounted at the opposite end of the shaft 215 from the arm 212 has operably connected thereto by a pin 228 a rod 230 actuated by a solenoid 232, and further there projects from the arm 226 a portion 234, shown in FIGS. 1A and 3 and in phantom in FIG. 1B and arranged to operatively contact a knocker arm 236 pivotally mounted on a pin 238 carried by a flange projecting from the base plate 22.

The knocker arm 236 is biased by the spring 138 so as to maintain an end portion 244 thereof in operative engagement with the portion 234 of the arm 226 while another end portion 246 of the knocker arm 236 has adjustably mounted therein a knocker bolt 247 which may be actuated by the portion 234 of the arm 226 into an operative engagement with the ends 301 and 301A of the slidable main and address code posts 260 and 260A carried by the outer wheel elements 40 and 42 of the code wheel assembly 38, as heretofore explained in the aforenoted U.S. application Ser. No. 306,792, filed Sept. 5, 1963, by Peter J. Caruso, and assigned to The Bendix Corporation.

Further, the pawl supporting member 84 has projecting therefrom a portion 108 of one end of the pin 95 so arranged as to operatively engage an arm 104 pivoted at 105 and biased by a leaf spring 106 so that a tooth 107 thereof normally engages teeth of an anti-advance ratchet gear 109, shown in FIGS. 1A, 2 and 6, and operating in a manner similar to the anti-advance ratchet shown and disclosed in a copending U.S. application Ser. No. 306,792.

The portion 108 of the pin 95 is arranged to actuate the arm 104 against leaf spring 106 so as to remove the tooth 107 of the spring biased arm 104 from engaging relation with the teeth of the ratchet 109 upon energization of the solenoid 130 and prior to advance of the ratchet wheel 36 by pawl 90 through operation of ratchet gear 93 under the force of spring 120 upon de-energization of the solenoid 130.

The pawl supporting member 84 has further connected thereto by the pin 95 the actuating linkage 110 operatively connected at an opposite end to the arm 112 through a pin 114 carried by the arm 112, as shown in FIGS. 1A and 6. A spring 120 biases the arm 112 about a pin 124 in a counterclockwise direction, as viewed in FIGS. 1A and 6 upon de-energization of the solenoid 130 and thereby the link 110 and the pawl 90 into operative engagement with the teeth of the gear portion 93 of the ratchet gear 36 to effect a counterclockwise step actuation of the ratchet gear 36.

The arm 112 is operatively connected by a pin 128 to the rod 129 actuated by the solenoid 130 which is electrically connected for operation, as shown schematically in FIGS. 1A and 1B. Thus, energization of the solenoid 130 actuates the arm 112 in a clockwise direction to condition the pawl 90 for the step actuation of the ratchet wheel 36 under the force of the spring 120 upon de-energization of the solenoid 130.

The pawl supporting member 184 has projecting therefrom a portion 208 of one end of the pin 195 so positioned, as shown in FIGS. 1A, 2, and 6 to cooperatively engage the spring biased arm 104 to move the tooth portion 107 thereof from engaging relation with the teeth of the anti-advance ratchet 109 prior to advance of the ratchet wheel 36 by pawl 190 in a manner similar to that described in the copending U.S. application Ser. No. 306,792.

Further, the pawl supporting member 184 has operatively connected thereto by the pin 195 an actuating linkage 210 which is operatively connected at an opposite end to an arm 212 through a pin 214 carried by the arm 212. Furthermore, the arm 212, as shown in FIG. 3, is biased in a counterclockwise direction and, as shown in FIG. 1A, in a clockwise direction, on shaft 215 upon energization of solenoid 232 so as to in turn bias the linkage 210 and the pawl actuating tooth 192 of the pawl 190 into operative engagement with the teeth of the toothed portion 193 of the ratchet gear 36. However, upon de-energization of solenoid 232, the spring 220 biases the arm 212 in a counterclockwise direction on the shaft 215, as viewed in FIG. 1A, and thereby the link 210 and the pawl 190 into operative engagement with the teeth of the toothed portion 193 of the ratchet gear 36 to effect a counterclockwise step actuation of the ratchet gear 36.

CODE WHEEL ASSEMBLY

The code wheel assembly 38, as shown schematically in FIG. 1B and structurally in FIG. 2, includes a plurality of primary or main locking code posts 260 and a plurality of secondary or auxiliary address code posts 260A, as hereinafter described, slidably mounted in openings 263 and 263A, respectively, in the outer wheel element 40 and openings 266 and 266A, respectively, in the outer wheel element 42. Each of the main code posts 260 include a member 261 positioned intermediate the opposite ends thereof having indented flat portions 262 and 264 arranged in spaced relation 180° apart. The indented portions 262 and 264 may be selectively positioned so as to so cooperate with a flange portion 265 of the inner wheel element 48 having indent portions 267 so arranged as to permit the inner wheel element 48 upon adjustment of the code post 260 in one sense, to move free of the outer wheel elements 40 and 42 against the light biasing force of the coupling spring 50, as explained in the copending U.S. application Ser. No. 306,792.

The inner wheel element 48, as best shown in FIGS. 1B and 2 includes the flange portion 265 having the indent portions 267 arranged to cooperate with raised portions 269 and 270 of the member 261 so as to lock the inner wheel element 48 in operative relation with the outer wheel elements 40 and 42, as shown for example, in FIG. 2, upon the main code post 260 being adjusted in a neutral position, shown in FIG. 2, or longitudinally to the left of FIG. 2, in response to an improper code bit.

The member 261 of the main code posts 260 has flange portions 271 and 273 positioned in spaced relation and so arranged as to be operatively engaged by release springs having spring legs 275 and 277. The springs are secured to the outer wheel elements 40 and 42 by bolts 278 and 279 and are so arranged that opposite end portions 281 and 285 of the spring legs 275 and 277 bear on the flange portions 271 and 273 of the member 261 so as to normally bias the main code posts 260 to the neutral position, shown in FIG. 2.

However, upon longitudinal actuation of the main code posts 260 in one sense, for example, to the right of FIG. 2, against the biasing force of spring 275, the member 261 of the main code posts will be adjusted so as to position the indent portion 262 thereof immediately adjacent the outer periphery of the flange portion 265 of the inner wheel 48 so as to release the same from a locking position relative to the outer wheels 40 and 42 and thereupon the outer diameter of the flange 265 of the inner wheel 48 is permitted to pass the code post at the indent portion. Conversely, upon actuation of the main code posts 260 in an opposite sense, for example to the left of FIG. 2, against the biasing force of the spring 277, the code posts may be so positioned that the raised portion 270 of the member 261 of the main code posts 260 is adjustably positioned in the indent portion 267 of the flange portion 265 of the inner wheel element 48 and in locking relation with the inner wheel element 48, as shown for example, in FIG. 2, whereupon the outer diameter of the flange portion 265 of the inner wheel is not permitted to pass the code post.

Figure 7:
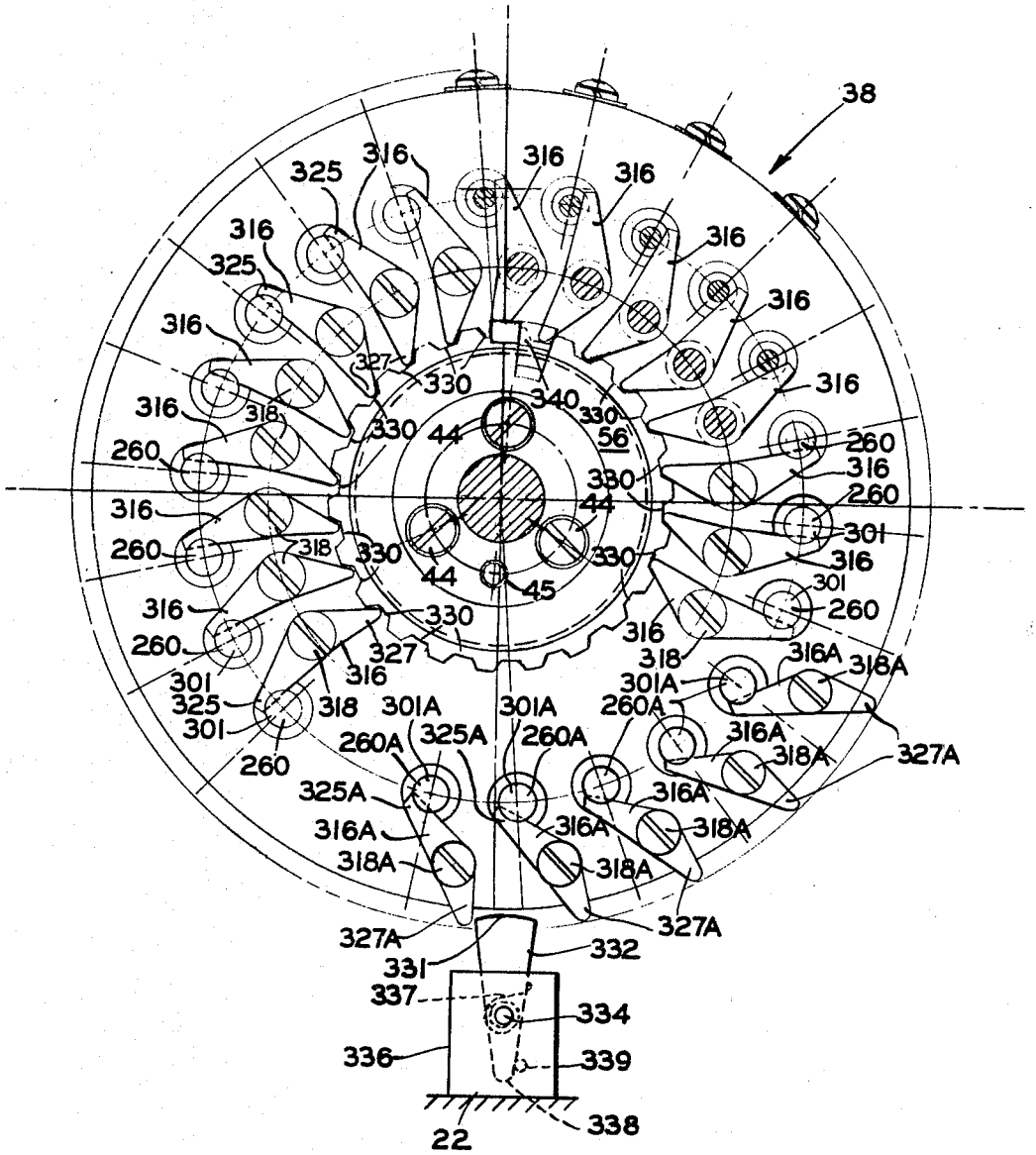
FIG. 7 is an end view of the code wheel assembly showing in greater detail the code post locking mechanism.

In the illustration of the invention herein provided, the first sixteen of the main code posts 260 may be of identical structure, while the last five auxiliary or address code posts 260A, as shown in FIGS. 2 and 7, are so constructed that the member 261A in the neutral position, as shown in FIG. 2, is so arranged as to be in an unlocking relation to a second inner wheel element 280. The second inner wheel element 280 is angularly movable relative to the wheel element 48 and has a flange portion 282 in which there is provided in the periphery thereof an indent portion 283. The second inner wheel element 280 has a toothed portion 284 and is coupled to the inner wheel 48 by a light coupling spring 285 which biases the toothed portion 284 into engaging relation with the pin 49 projecting from the inner wheel element 48. The second inner wheel element 280 is biased by the spring 285 in a clockwise or opposite direction from that of the biasing force of the spring 50 acting in a direction corresponding to the counterclockwise direction of actuation of the stepper ratchet wheel 36. The coupling spring 285 is connected at one end 286 to the second inner wheel element 280 at 287 and at the opposite end 288 to the other inner wheel element 48 at 289.

There projects from the flange portion 282 of the second inner wheel element 280 a pin 290 normally biased, as viewed in FIG. 1B, in a counterclockwise direction in an arcuate slot 292 provided in the outer wheel element 42 by the preload of coupling spring 50 acting through inner wheel element 48 and pin 49 engaging the toothed portion 284 of the wheel 280. The pin 290 projects through the slot 292 into an indent portion 294 of an operating arm 295 for selectively positioning the switch mechanism 297, as hereinafter explained.

The member 261A of the auxiliary code post 260A includes flange portions 271A and 273A mounted in spaced relation on the code post 260A and so arranged that the flange portion 273A may be adjustably positioned into engaging relation in the indent portion 283 of the flange portion 282 of the wheel element 280. The flange portion 273A is positioned in a disengaging relation to the indent portion 283 of the flange portion 282 when in the normal neutral position shown in FIG. 2 However, upon a longitudinal movement of the auxiliary code posts 260A to the right, as shown in FIG. 2, the flange portion 273A will lock in the indent portion 283 so as to lock the second inner wheel element 280 to the outer wheel element 40–42.

Corresponding parts in the code post 260A to those described with reference to the code post 260 have been identified in FIG. 2 by like numerals bearing the suffix A.

Thus, a nonswitch selecting code signal causing the knocker arm 236 to actuate the code post 260A to the left will cause the code post 260A to remain in an unlocked relation to the indent portion 283 while a switch selecting code signal will cause the knocker arm 135 to actuate the auxiliary address code post 260A to the right from the neutral position shown in FIG. 2, into a locking position relative to the indent portion 283 of the inner wheel element 280. This locking action of the auxiliary code post 260A will then drivingly connect the outer wheel elements 40–42 to the second inner wheel element 280 to effect angular movement thereof in a counterclockwise direction relative to the inner wheel element 48 to follow the counterclockwise step action of the outer wheel elements 40–42 upon the pin 49 engaging the locking arm 342 and the outer wheel elements 40–42 being unlocked from the inner wheel element 48, as hereinafter explained.

Such counterclockwise angular movement of the second inner wheel element 280 relative to the inner wheel element 48 will in turn effect a selective operation of the switch mechanism 297 drivingly connected to the second inner wheel element 280 through the pin 290 and switch operating arm 295.

The auxiliary address code posts 260A in the seventeenth through the twenty-first positions of the code wheel assembly 38 have a predetermined and fixed relation to a particular switch function.

The main code posts 260, however, may be selectively rotated 180° by a remote code change mechanism, as explained in the U.S. application Ser. No. 328,083, so as to change the operative relation thereof from that shown in FIG. 2. The detent portion 264 would then be operative upon actuation of the main code post 260 to the left to release the inner wheel element 48. While the raised portion 269 would be operative to retain the inner wheel element 48 and outer wheel elements 40 and 42 in a locked relation upon actuation of the main code post 260 longitudinally to the right.

The actuation of the main code posts 260 in the one and other senses described in reference to FIG. 2, may be selectively effected by the knocker arm 135, and the knocker arm 236, as shown in FIGS. 1 and 2, and the code wheel assembly 38 may be rotated in a step action by the pawl actuating mechanism 81 and 82 in operative relation with the ratchet wheel 36.

The auxiliary code posts 260A may be similarly selectively actuated by the knocker arms 135 and 236 from the unlocked neutral position shown in FIG. 2 into a locked relation between the second inner wheel element 280 and the outer wheel elements 40 and 42 after receipt of a predetermined code signal to effect a selective operation of the switch mechanism 297, as hereinafter explained, while remaining in an unlocked relation upon receipt of a nonswitch selecting code signal.

Selective energization of the solenoids 130 and 232 control respectively the knocker arms 135 and 236 and the tension applied to the code wheel advance springs 120 and 220, as shown in FIGS. 1A, 3 and 6. While upon de-energization of the selected solenoid 130 or 232, as the case may be, the energy stored in the code wheel advance spring 70 becomes effective to actuate the pawl actuating mechanism 81 or 82, as shown by FIGS. 1A, 2, and 6, and thereby cause the ratchet wheel 36 to move the code wheel assembly 38 to the next succeeding position with a step action.

In the step actuation of the ratchet wheel 36, the energization of the selected solenoid (130 or 232) conditions the pawl (90 or 190) controlled thereby for operation relative to the ratchet wheel 36 while the other pawl holds the ratchet wheel 36 and thereby the code wheel assembly 38 in a fixed position until de-energization of the selected solenoid renders the tensioned code wheel advance spring (120 or 220) effective to cause the controlled pawl to actuate the code wheel assembly 38 to the next succeding position for effecting successive operation of the several code posts 260, as hereinafter described in greater detail.

Further, each of the main code posts 260 includes an end portion 300 protruding from the outer wheel element 40 and arranged for selective operation by the end portion 140 of the knocker arm 135, as shown in FIGS. 1B and 2, while the opposite end of the main code post 260 includes an end portion 301 protruding from the outer wheel element 42 and arranged for actuation by the end portion 246 of the knocker arm 236, as shown in FIGS. 1B and 2.

In an end portion of the main code post 260, there are arranged longitudinal slots 305, as possibly best shown in FIG. 2. Cooperating with the slots 305 is a ball detent 307 biased by a spring 309 held by a bolt 310 so as to releasably resist angular rotation of the main code post 260 and thereby maintain the same in an angularly adjusted position in the outer wheel elements 40 and 42.

Further, at the end portion 300 of the main code posts 260, there is provided, as shown in FIG. 2, a flange portion 311 and indent portions 312 and 314 arranged in spaced relation so as to cooperate with a locking detent member 316, shown in FIG. 7, upon actuation of the main code posts 260 in one or the other of the longitudinal senses as illustrated and explained in the U.S. application Ser. No. 306,792.

The auxiliary code posts 260A, as shown in FIG. 2, have arranged in cooperative relation with a locking detent 316A a similar flange portion 311A and indent portions 312A and 314A to that of the main code posts 260. Corresponding parts are indicated in the auxiliary code posts 260A by corresponding numerals to which has been added the suffix A for the parts of the auxiliary code posts 260A.

Each of the locking detent members 316, as shown in FIG. 7, are pivotally mounted by a bolt 318 secured at 319 in the outer surface of the outer wheel element 40 and located radially inward of the openings 263. The locking detent members 316 are biased by a spring 320 having one end engaged in an opening 321 in the outer surface of the wheel element 40 and another end bearing on the detent member 316 so as to bias the end portion 325 of the locking detent member 316 into cooperative engagement in the indent portion 312 or 314, as the case may be, upon longitudinal actuation of the code posts 260 from the neutral position, shown in FIG. 2, to one or the other of the locking positions. The opposite end portion 327 of each detent member 316 is positioned in a recess 330 formed in the periphery of the reset wheel 56, as shown in FIGS. 1B, 2, and 7.

As distinguished from the locking detent members 316 for the main code posts 260, the locking detent members 316A for the auxiliary code posts 260A, as shown in FIGS. 1B, 2, and 7, are pivotally mounted by a bolt 318A secured at 319A in the outer surface of the outer wheel element 40 and located radially outward of the opening 263A. The locking detent members 316A are biased by a spring 320A having one end engaged in an opening 321A in the outer surface of the wheel element 40 and another end bearing on the detent member 316A so as to bias the end portion 325A of the locking detent member 316A into cooperative engagement in the indent portion 312A or 314A, as the case may be, upon longitudinal actuation of the code post 260A from the neutral position, shown in FIG. 2, to one or the other of the locking positions.

The opposite end portion 327A of each of the detent members 316A extends beyond the perimeter of the outer wheel element 40, and as shown in FIGS. 1B and 7, is arranged in cooperative relation with an end portion 331 of a pawl 332. The pawl 332 is pivotally mounted by a bolt 334 carried by a bracket 336 supported by the base plate 22. The pawl 332 is biased by a spring 337 having one end secured in the bracket 336 and another end bearing on the pawl 332 so as to bias the pawl 332 in a counterclockwise direction, as viewed in FIGS. 1B and 7, about the bolt 334 and an end portion 338 of the pawl 332 into engaging relation with a stop pin 339 carried by the bracket 336.

The arrangement of the pawl 332 is such that upon a counterclockwise step actuation of the code wheel assembly 38, the end portion 327A of the detent members 316A engage successively the end portion 331 of the pawl 332 so as to bias the pawl 332 in a clockwise direction against the biasing force of the spring 337 and away from the stop pin 339 so as to permit the passage of the end portions 327A of the detent members 316A in a counterclockwise direction over the end portion 331 of the pivoted pawl 332 in opposition to the biasing force of the spring 337.

However, upon a return movement of the code wheel assembly 38 in a clockwise direction under the biasing force of the return spring 70, the end portions 327A of the detent members 316A successively contact the end portion 331 of the pawl 332 which is held from a pivotal movement in a counterclockwise direction by the stop pin 339 whereupon the detent members 316A are pivoted in a counterclockwise direction about the pin 318A against the biasing force of the spring 320A, away from the auxiliary code posts 260A and out of the indent portions 312A or 314A thereof, as the case may be, permitting the return longitudinal actuation of the auxiliary code post 316A to the neutral position under the biasing force of the leaf spring 275A or 277A, shown by FIG. 2. Thus, release of the auxiliary code posts 260A to the neutral position is effected upon return of the code wheel assembly 38 in a clockwise direction toward the null, home, or start position.

In order to effect the return of the main code posts 260 to the neutral position, the outer wheel element 40 has the pin 68 projecting from the outer wheel surface thereof into the slot 69 provided in the reset wheel 56 and arranged so as to limit angular movement of the reset wheel 56 relative to the outer wheel element 40. Further, as explained in the copending U.S. application Ser. No. 306,792, there projects from the opposite side of the reset wheel 56 an arm 340 arranged to engage the extended portion 510 of the pawl lift or pick-up device 102 so as to effectively actuate the reset wheel 56 and the detent members 316 against the biasing force of the springs 320, away from the main code posts 260 and out of the indent portions 312 or 314 thereof as the case may be, permitting the return longitudinal actuation of the main code posts to the neutral position under the biasing force of the leaf spring 275 or 277, shown by FIG. 2.

The slot 69 cooperates with the pin 68 to limit clockwise movement of reset wheel 56 under the biasing force of spring 58. Thus, release of the main code posts 260 to the neutral position is effected upon return of the code wheel assembly 38 in a clockwise direction to the null, home, or start position.

Moreover, upon de-energization of the solenoid 452 controlling the pick-up device 102 by the opening of switch 450, the end portion 510 returns from the raised dotted line position of FIG. 2, to the solid line normal position out of engaging relation with arm 340 whereupon the detent members 316 under the biasing force of spring 320 return to an operative relation with the flange portions 311 of the main code posts 260.

Further, as shown in FIGS. 1B and 2, there projects from the inner wheel element 48 a pin 49 which extends through the arcuate slot 55 in the outer wheel element 42 into engaging relation with a stop arm 342 pivotally mounted on a bolt 345 projecting from the end plate 28, as shown in FIGS. 1B, 2, 3, and 4 so as to limit the extent of angular movement of the code wheel assembly 38 in a counterclockwise direction by the stepping action of pawls 90 and 190.

Thus, in the event the outer wheel elements 40 and 42 remain in a locked relation with the inner wheel element 48 following receipt of a faulty decoding message, the pin 49 operatively engages the stop arm 342 which is biased into operative engagement therewith by a spring 347. The spring 347 normally holds a portion 348 of the arm 342 in abutting relation with a stop bolt 349, as shown in FIGS. 1B, 2, and 3. The force asserted by the code wheel advance spring (120 or 220) is sufficient, however, to overcome the biasing force of the spring 347 whereupon the arm 342 effects a step operation of a counting mechanism 350, shown in FIG. 4, which is thereafter effective to lock the decoding mechanism from further operation until return to the safe, home, or null position, as hereinafter explained.

Figure 5:
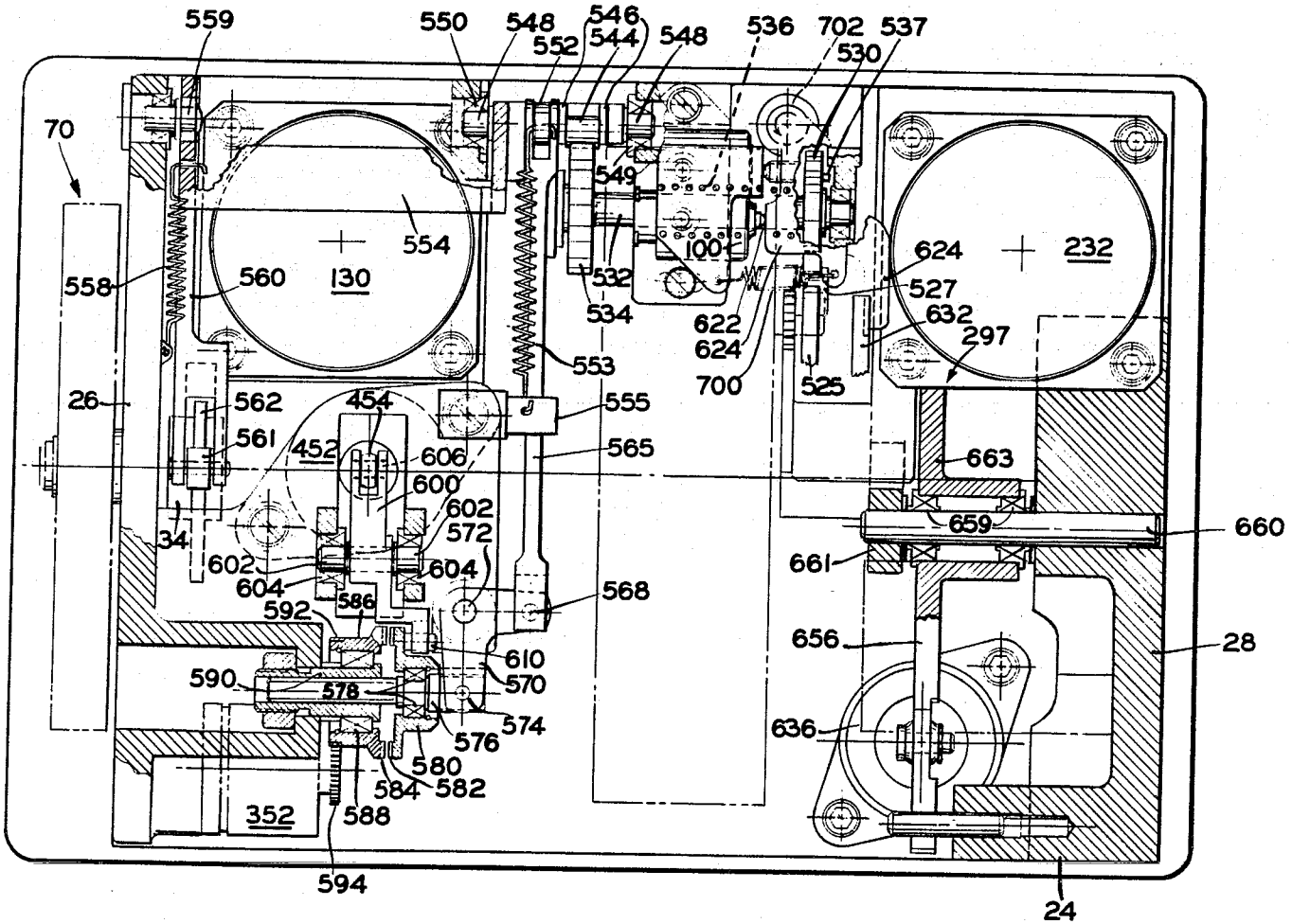
FIG. 5 is a top plan view of FIG. 2 illustrating the cooperative relationship of the actuating solenoids of the counter mechanism, transfer switch, timer clutch and timer mechanism.

Furthermore, after a predetermined number of unsuccessful attempts to operate the decoder mechanism, the counting mechanism 350 will render effective a timer 352, as shown in FIG. 5, to render the operating mechanism for the decoder unit ineffective over a predetermined time interval, as hereinafter explained.

However, upon a proper decoding message being received by the decoder unit causing the locking posts 260 to be selectively actuated so as to unlock the inner wheel element 48 from the outer wheel elements 40 and 42 and permit free angular movement of the outer wheel elements 40 and 42 relative to the inner wheel element 48 upon the completion of the decoding message at which time the pin 49 of the inner wheel element 48 operatively engages the stop arm 342, the biasing force asserted by the spring 347 is sufficient to hold the stop arm 342 against the biasing force of light coupling spring 50 while the biasing force asserted by the code wheel advance spring (120 or 220) is sufficient to overcome the resilient force applied through the light coupling spring 50 to the inner wheel element 48 so as to permit further angular movement of the outer wheel elements 40 and 42 in a counterclockwise direction relative to the inner wheel element 48 held by the stop arm 342 and subject to proper actuation of the auxiliary address code posts 260A in the 17th, 18th, 19th, 20th, and 21st positions of the outer wheel elements 40 and 42.

Thus, the inner wheel element 48 is held by the pin 49 engaging the stop 342 under the biasing force of spring 347 while the outer wheel elements 40 and 42 of the code wheel assembly 38 may continue to be driven in a counterclockwise direction, as viewed in FIG. 1B, by the actuating pawls 90 or 190 while the pin 49 is arcuately movable in the slot 55 and the pin 290 is arcuately movable in the slot 292 subject to the proper selective actuation of the code posts 260A in the 17th, 18th, 19th, 20th, and 21st positions so as to lock the second inner wheel element 280 to the outer wheel elements 40 and 42 to effect the desired operation of the selector switch 297.

The code posts 260A, as shown in FIG. 2, are so arranged that, in the neutral position, the same are held in unlocked relation to the second inner wheel 280. Thus, a code signal selectively applied, for example, through the solenoid 232 so as to cause the knocker arm 236 to actuate code post 260A in a longitudinal sense to the left will cause the code post 260A to remain in an unlocked relation with respect to the second inner wheel element 280. However, if a code signal is applied, for example, to the solenoid 130 so as to cause the knocker arm 135 to actuate code post 260A in an opposite longitudinal sense to the right so as to cause the member 261A to actuate the flange portion 273A into locking relation with the indent portion 283 of the flange portion 282 of the second inner wheel element 280, such action will cause the code post 260A to lock the second inner wheel element 280 to the outer wheel elements 40 and 42. This action will then prevent any further angular advance of the outer wheel element 40 and 42 relative to the second inner wheel elements 280 under a biasing force of the code wheel advance spring 120 or 220 while permitting the angular movement of the outer wheel elements 40 and 42 relative to the inner wheel element 48.

In the event that the 17th to the 21st code signals are properly applied, the outer wheel elements 40 and 42, together with the shaft 34 are step actuated by the selective actuation of the pawls 90 and 190 so as to effect selective operation of the control switch mechanism 297, as hereinafter explained.

Figure 8:
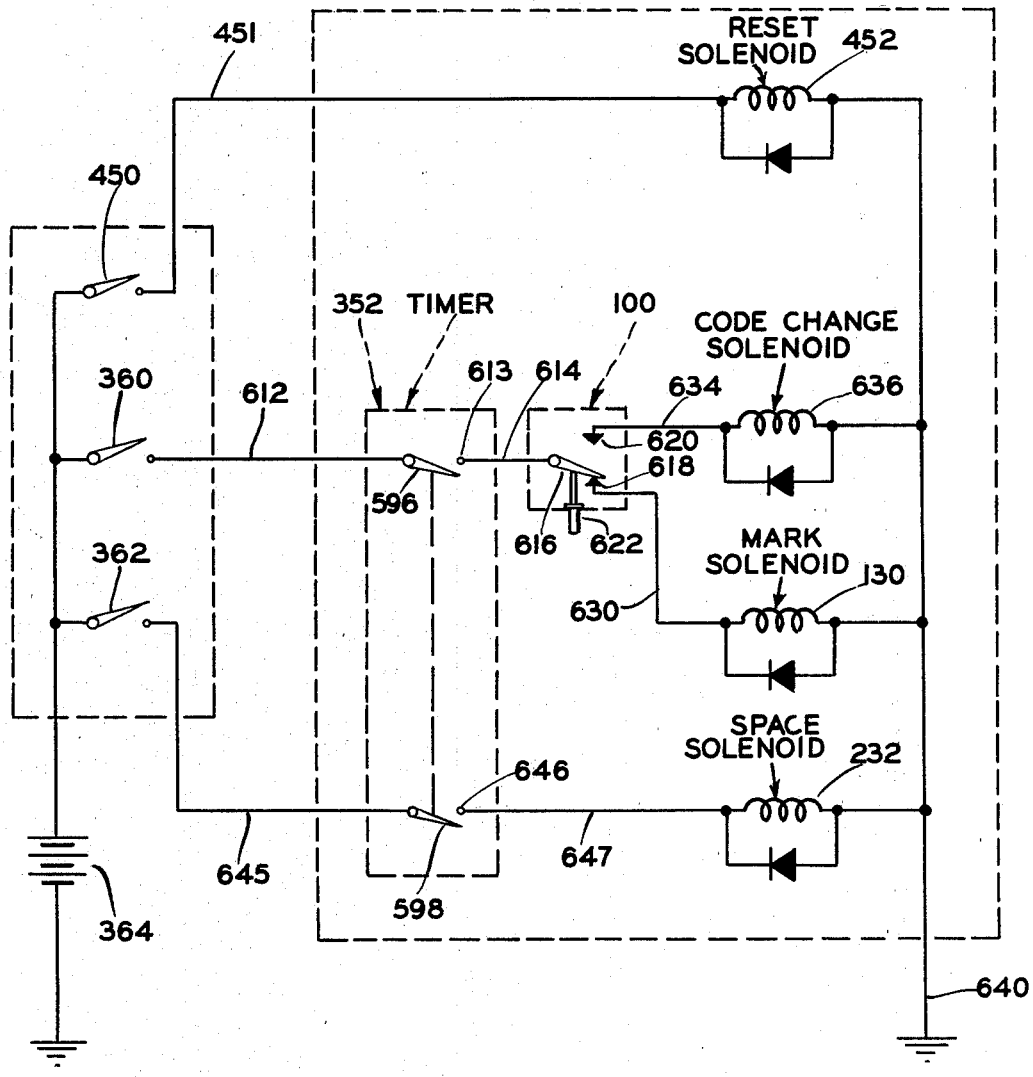
FIG. 8 is a wiring diagram of the control switches and actuating solenoids of the decoder mechanism.

The selective actuation of the solenoids 130 and 232 will provide the required decoding message to effect the unlocking action of the main code posts 260 of the outer wheel elements 40 and 42 relative to the inner wheel element 48 as well as the selective actuation of the address auxiliary code posts 260A and thereby effect selective operation of the control switch mechanism 297, as hereinafter explained. The selective actuation of the solenoids 130 and 232 effecting the decoding message may be provided by the selective operation of suitable switches 360 and 362 controlling energizing circuits from a battery 364 for the respective solenoids 130 and 232, as shown in FIGS. 1A, 1B, and 8, as hereinafter explained.

SELECTIVE SWITCH CONTROL MECHANISM

Upon the outer wheel elements 40 and 42 being unlocked from the inner wheel element 48, the further angular adjustment of the outer wheel elements 40 and 42 relative to the inner wheel element 48 through the pawl actuating mechanisms 81 and 82 causes the shaft 34 to be angularly adjusted so as to in turn position a rotary switch structure 370, shown in FIGS. 1B, 2, and 3 and drivingly connected to the shaft 34 by a key 372.

The rotary switch 370, as shown in FIG. 3, includes a core 374 on which is affixed an annular member 376 formed of a suitable electrical insulating material having annular ribs 377, as shown in FIG. 2. Embedded in the electrical insulating material 376 and intermediate the ribs 377 are a series of segmental electrical conductors 379 having electrical contact members 381 and 383 positioned at the opposite ends of the electrical conductor 379 and so arranged as to cooperate with multiple pairs of spring switch arms 385A–E and 387A–E, as shown in FIGS. 1B and 3, and carried by an insulation block 389 affixed to the end plate 28 by bolts 391 and 393.

The arrangement of the rotary switch 370 is such that switch arms 385A–E and 387A–E are effective to close the contacts 381 and 383 of the electrical conductors 379 upon the shaft 34 being angularly adjusted to a predetermined position such as, for example, the 21st bit position of the code wheel assembly 38, as hereinafter explained.

In addition to the rotary switch structure 370 operatively connected to the shaft 34 by the key 372, there is provided a second rotary switch structure 400 which is rotatably mounted on the shaft 34 by suitable bearings 402, as shown by FIG. 2. The rotary switch structure 400 includes an annular core 404 rotatably mounted on the bearings 402 and on which there is affixed an annular member 406 formed of a suitable electrical insulating material and including ribs 407 between each of which there are provided suitable electrical contact members 409–411 arranged in a predetermined relation and connected by electrical conductors 412 embedded in the electrical insulating material 406, as in the case of the conductor 379 of the rotary switch 370 of FIG. 3. The contact members 409 and 411 are selectively closed by multiple pairs of spring switch arms 413A–E and 414A–E upon the angular adjusted positioning of the rotary selected switch 400 relative thereto. The rotary switch 400 includes a switch operating arm 295 operatively connected through the indent portion 294 to the pin 290 projecting from the second wheel element 280, as heretofore explained.

The angular adjusted position of the rotary selector switch 400 relative to the outer wheel elements 40–42 and in turn to the spring switch arms 413A–E and 414A–E will be dependent upon the selective actuation of the auxiliary address code posts 260A to effect the selective locking of the inner wheel element 280 to the outer wheel element 42 and thereby the angular adjusted position of the pin 290 in the slot 292 in opposition to the biasing force of the light coupling spring 285.

The multiple pairs of spring switch arms 413A–E and 414A–E, as shown in FIG. 1B, are carried by an insulation block 415 which, like the block 389, may be secured to the end plate 28 by the bolts 391 and 393.

The spring switch arms 414A–E of the rotary selected switch 400 are connected to a suitable source of electrical energy 416 while the switch arms 413A–E are in turn connected to the corresponding spring switch arms 385A–E of the qualifying switch 370 through suitable electrical conductors 417.

The other spring switch arms 387A–E of the qualifying switch 370 are connected through electrical conductors 419A–E to suitble electrical devices 421, 422, 423, 424 and 425 to be controlled thereby, such as for example, devices for controlling initiation of ignition of various stages of a missile, safety and arm switch mechanisms, or devices for effecting a given number of sequential operations where security and reliability is a prime consideration.

The arrangement is such that the selected closure of one or the other of the pairs of spring switch arms 413A–E and 414A–E of the rotary switch 400 will not be effective until the qualifying spring switch arms 385A–E and 387A–E of the rotary switch 370 have also been closed upon the shaft 34 being angularly adjusted to a predetermined position, i.e. the final step of operation, that is, for example, the 21st bit position and after the outer wheel elements 40 and 42 have been unlocked from the inner wheel element 48 by the application of a proper input code to the code posts 260.

However, upon the outer wheel elements 40 and 42 remaining in a locked relation with the inner wheel element 48 following receipt of a faulty decoding message, the engagement of the pin 49 with the stop arm 342 at the limit of the counterclockwise rotation thereof provided by the step actuation of the pawls 90 or 190, as shown in FIGS. 1A, 2, and 6. The engagement of pin 49 with arm 342 serves to prevent the additional angular adjustment of the shaft 34 necessary to effect the selective operation of the auxiliary address code posts 260A and thus prevents the selective operation of the rotary switch mechanisms 297. In the latter case, or in any position of the code wheel assembly 38 intermediate such position and the home position, the operator may effect the return of the code wheel assembly to the home position by the operation of the code wheel assembly reset mechanism 102.

CODE WHEEL ASSEMBLY RESET MECHANISM

In order to effect the reset operation of the code wheel assembly 38, there is provided a switch 450 or other suitable means for controlling the circuit from the battery 364 by closure of a conductor 451, shown in FIG. 1A, for effecting energization of a solenoid 452. Energization of the solenoid 452 is effective to operatively position upwardly an actuating rod or plunger 454 so as to in turn actuate the pick-up device 102 in an upward direction to effect the pick up of the pawls 90 and 190 and render the code wheel assembly 38 effective to return in a clockwise direction, as viewed in FIGS. 1, 2, and 6 to the start, null, or home position under the biasing force of the spring 70.

In effecting the last-mentioned pick-up action, the device 102 includes the pick-up member having portions 506 and 508 arranged to engage the end portions 100 and 200 of the pawls 90 and 190 so as to raise the same from the gear portions 93 and 193 of the ratchet wheel 36. The portion 508 of the pick-up device 102 also includes an extended portion 510 which, as explained in the copending U.S. application Ser. No. 306,792, is so arranged that when in the raised position, it is effective to engage the arm 340 projecting from the reset wheel 56, as shown in FIGS. 1B and 2, upon the code wheel assembly 38 being driven in the clockwise or home direction under the biasing force of the spring 70 so as to actuate the reset wheel 56 in an opposite or counterclockwise sense, as viewed in FIGS. 1B and 7, relative to the outer wheel element 40 and in opposition to the biasing force of the spring 58, upon the arm 340 approaching the home position.

The actuation of the reset wheel 56, in the counterclockwise sense relative to the code wheel assembly 38, as shown in FIG. 7, causes the end portions 327 of the locking detent 316 in the recesses 330 of the reset wheel 56 to be positioned in a clockwise direction against spring 320 and thereby the end portion 325 so as to release the code posts 260 under the biasing forces of the spring elements 275 and 277 whereupon the code posts 260 may be returned to the neutral position, shown in FIG. 2.

Thereafter, upon the opening of the control switch 450, the solenoid 452 is de-energized and the actuating rod 454 is biased under the force of suitable spring means (not shown) in the solenoid 452 to the downward return position so as to cause the portions 506 and 508 of the pick-up member to release the pawls 90 and 190 and the extended portion 510 of the pick-up member, as shown in FIG. 2, to release the arm 340 whereupon the spring 58 biases the reset wheel 56 in a clockwise direction relative to the outer wheel element 40 so that detent members 316 under the biasing force of springs 320 are released for normal operative relation with the flange portions 311 of the main code posts 260.

The reset disc 56 is freely mounted on the shaft 34 and normally follows the adjustment of the outer wheel element 40 within the limits of the movement of pin 68 in the slot 69 of FIGS. 1B and 2 through the action of the light coupling spring 58 so that the locking detent members 316 under the biasing force of the springs 320, shown in FIGS. 1B, 2, and 7 are rendered effective to lock the code posts 260 in one or the other of the actuated positions thereof, as heretofore explained in the copending Ser. No. 306,792, upon the selective operation thereof by the knocker arms 135 and 236, respectively.

COUNTER OPERATION

Furthermore, upon the outer wheel elements 40 and 42 remaining in a locked relation with the inner wheel element 48 following receipt of a faulty decoding message, the engagement of the pin 49 with the stop arm 342 at the limit of the rotation thereof provided by the step action of the pawsl 90 or 190 will prevent the subsequent angular adjustment of the shaft 34 necessary to effect the control operation of the switch mechanism 400.

Figure 4:
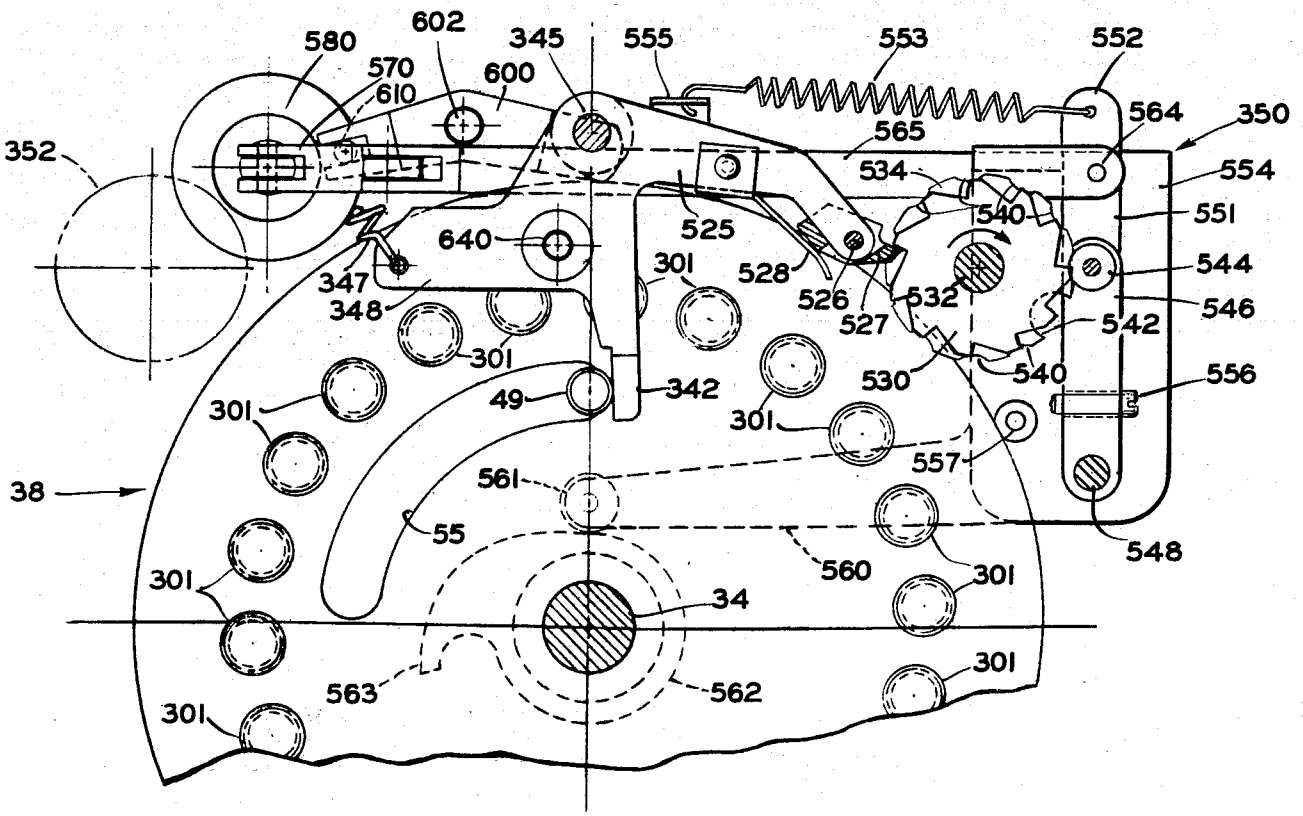
FIG. 4 is an enlarged fragmentary end view of the code wheel assembly of FIG. 3 showing the cooperative relationship of the timer arm and counter mechanism.

Furthermore, the engagement of the stop arm 342 by the pin 49 will actuate the stop arm 342, as viewed in FIG. 1B, in a clockwise direction about the pivot pin 345, and as viewed in FIGS. 3 and 4 in a counterclockwise direction about the pivot pin 345. The stop arm 342 includes an arm portion 525 to which there is pivotally mounted at 526 a pawl 527, shown in FIGS. 1B, 3 and 4 biased by a leaf spring 528 into operative engagement with teeth of a star wheel 530. The star wheel 530 is connected by a shaft 532 to a counter wheel 534, shown in FIGS. 1A and 5. The star wheel 530 and counter wheel 534 will be biased to a home position by a suitable return spring 536, shown in FIGS. 1B and 5. The home position of the star wheel 530 being determined by a pin 537 carried by the star wheel 530 and arranged to engage a stop pin 538 at the home position, as shown in FIG. 1B.

The counter wheel 534 has a plurality of detent slots 540 and a deep control slot 542, as shown in FIG. 1A, arranged in cooperative relation to a detent roller 544 carried by control arms 546 affixed to a shaft 548 rotatably mounted in bearings 549 and 550, as shown in FIG. 5.

Further, affixed to the shaft 548 is an arm 551 having an end portion 552 connected to an end of a spring 553 which is in turn secured to a supporting bracket 555. The spring 553, as shown in FIG. 4, biases the arm 551 in a counterclockwise direction and the detent roller 544 into the detent slots 540 and 542 in the counter wheel 534. Adjustably mounted in the arm 551 and projecting therethrough is a bolt 556 arranged to operatively engage a pin 557 carried by a bracket 554 having one end thereof freely mounted on an end of the shaft 548.

The pin 557 carried by the bracket 554 is arranged to engage an end of the bolt 556 so as to angularly position the arm 551 and thereby the control arms 546 in a clockwise sense so as to raise or lift the detent roller 544, as shown in FIG. 4, out of said deep control slot 542 to permit the return of the counter wheel 534 and star wheel 530 to a home position under the biasing force of the return spring 536, shown in FIGS. 1B and 5.

In order to effect the lifting of the detent roller 544 out of the deep control slot 542, one end of the shaft 548 is freely mounted in an end of the bracket 554 while an opposite end of the bracket 554 has projecting therein a stub shaft 559, which as shown in FIGS. 1A and 5, is concentric with the shaft 548 and rotatably supports the bracket 554. There projects from the opposite end of the bracket 554 a cam follower arm 560 having a roller 561 at the free end thereof biased by a spring 558 in a counterclockwise direction, as viewed in FIGS. 1A, into cooperative relation with a cam 562 affixed to the shaft 34, and having a raised portion 563.

Further, as shown in FIG. 5, the spring 558 is fastened at one end to the bulkhead end portion 26 and at an opposite end to the bracket 554 so as to bias the bracket 554, arm 560 projecting therefrom, and thereby the cam follower roller 561 carried by the arm 560 into contacting relation with the cam surface of the cam 562 affixed to the shaft 34.

The arrangement is such that through cooperation of the pin 557 of the bracket 554 with the bolt 556 of the arm 551, the raised portion 563 of the cam 562 actuates the arm 560 against the biasing force of spring 558 so as to lift the lever 546 and thereby the detent roller 544 carried thereby out of the deep control slot 542 upon the step actuation of the shaft 34 to the final step position, i.e., the 21st bit position whereupon the star wheel 530 and counter wheel 534 under the biasing force of the spring 536 are returned to a home position determined by the pin 537 and stop pin 538.

The cam 562, as shown in dotted lines in FIG. 4, has the raised portion 563 so arranged as to engage in limiting relation with the roller 561 in the start, home or null position of the shaft 34.

Operatively connected to the lever 551 by a pin 564 is one end of a linkage 565. As shown by FIG. 4, the spring 553 biases the arm 551 in a counterclockwise direction and the roller 544 into contacting relation with the counter wheel 534. Further, as shown by FIG. 5, there is operatively connected to the opposite end of the linkage 565 by a pin 568 a bell crank lever 570 pivoted at 572. The bell crank lever 570 is in turn connected by a pin 574 to a stub shaft 576 rotatably mounted in bearings 578 carried by a coupling member 580 having jaw teeth 582 arranged to be positioned into operative engagement with jaw teeth 584 carried by a coupling member 586 rotatably mounted on bearings 588 carried by a stub shaft 590. The coupling member 586 has gear teeth 592 arranged in operative engagement with teeth of a gear 594 for winding a spring, not shown, of the timer mechanism 352 which may be of a conventional type including suitable limit switch elements 596 and 598, shown schematically in FIG. 8, to open respectively the control circuits from the switches 360 and 362 upon the timer mechanism 352 being actuated by the winding operation of the gear 594. The timer 352 is arranged to retain the limit switch elements 596 and 598 in open circuit positions for a predetermined time interval until the spring of the timer mechanism 352 has become unwound.

The coupling member 580 is actuated into engaging relation with the coupling member 586 for effecting the winding operation upon the roller 544 under the biasing force of spring 553 dropping into the deep control slot 542 of the control wheel 534 after a predetermined cycle of unsuccessful attempts to operate the decoding mechanism 38. In the latter action, the deep control slot 542, as shown in FIG. 4 and schematically in FIG. 1A, is adjusted into coincidence with the roller 544 whereupon under the biasing force of the spring 553, the control arms 546, as viewed in FIG. 4, affixed to shaft 548, angularly rotates the shaft 548 in the bearings 549 and 550 in a counterclockwise direction within the limits permitted by the depth of the control slot 542. This action in turn is transmitted by the linkage 565 to the bell crank lever 570 to cause the coupling member 580 to engage the coupling member 586.

Thereafter, upon the reset switch 450, as shown in FIGS. 1A and 8, being closed by the operator or by a suitable operating mechanism, the reset solenoid 452 is energized actuating the plunger 454 and thereby the pawl pick-up member 506–508 to lift the pawls 90 and 190 out of engaging relation with the ratchet wheel 36 so as to permit the return of the code wheel assembly 38 to the start position under the biasing force of the return spring 70 while at the same time the actuation of the plunger 454 operates a lever 600.

The lever 600 is pivotally mounted intermediate the opposite ends thereof by pin 602 in bearings 604, as shown in FIG. 5, and at one end thereof the lever 600 is pivotally connected by a bolt 606 to the plunger 454 while the opposite end of the lever 600 is pivotally connected by a pin 610 to the coupling member 580 so that, upon energization of the reset solenoid 452, after actuation of the coupling member 580 into engaging relation with the coupling member 586, the coupling members 580 and 586 may be angularly actuated on the bearings 578 and 588 causing the gear teeth 592 in engaging relation with the teeth of the gear 594 to drive the gear 594 so as to wind a spring of conventional type in the timer 352.

The winding of the spring of the timer 352, as heretofore explained, causes the limit switch elements 596 and 598, shown in FIG. 8, to be held in an open position for a predetermined time interval until the spring of the timer 352 had been unwound. As shown in FIGS. 1A and 8, the limit switch element 596 of the timer 352 is connected by an electrical conductor 612 to the mark and code change control switch 360 and upon closure thereof to a suitable source of electrical energy or battery 364. The limit switch element 596, as shown in FIG. 8, controls a contact 613 connected by an electrical conductor 614 to a switch element 616 of the transfer switch which is normally in a position closing a switch contact 618. The contact 618 is connected by an electrical conductor 630 to the mark or control solenoid 130.

The limit switch element 598 of the timer 352 is connected by an electrical conductor 645 to the space control switch 362 and thereby to the source of electrical energy or battery 364. The limit switch element 598 controls a switch contact 646 which is connected by an electrical conductor 647 to the space solenoid 232, the opposite terminal of which is connected to the ground conductor 640.

From the aforenoted arrangement, it will be seen that so long as the limit switches 596 and 598 remain closed operation of the mark and space solenoids 130 and 232 may be selectively effected by the operation of the control switches 360 and 362 which may be manually operated or may be connected through suitable control mechanism in the normal range of operation.

REMOTE CODE CHANGE

Implementing a code change in the electromechanical decoder is accomplished by the changing of the presentation of the code post 260 relative to the inner code wheel 48, as shown in FIGS. 1B and 3, and explained in the copending U.S. application Ser. No. 328,083. The remote code change device includes a code change solenoid 636, the energization of which may be effected by the operator closing a switch 360, as shown in FIGS. 1A and 8, upon the transfer switch 100 being actuated to a position in which the switch member 616 closes contact 620.

The foregoing is effected upon the code wheel assembly 38 reaching a predetermined position, i.e., the final step of operation, the 21st bit position, as hereinafter explained, the actuation of the button 622 by the lever 624, as shown in FIG. 5, causes the transfer switch 100 to actuate the switch element 616 from a position closing the switch contact 618, as shown schematically in FIG. 8, to a position closing the contact 620 and thereafter upon the code wheel assembly 38 being returned to the home position by the closure of the reset switch 450 and upon the opening of the switch 450, the control switch 360 will then be effective for controlling the operation of the code change solenoid 636 of FIGS. 1B, 3, and 8 until such time as the switch element 616 has been returned to a position opening the switch contact 620 and again closing the switch contact 618, as hereinafter explained, whereupon the "mark" control switch 360 is once again effective to control the "mark" solenoid 130.

The code change solenoid 636 includes a rod or plunger 654 actuated upon energization of the solenoid 636 to position a code change arm 656 operatively connected to the plunger 654 by a pin 658. The arm 656, as shown in FIG. 5, is pivotally mounted on bearings 659 carried by a pin 660 mounted in a flange 661 and in the end portion 28 of the bulkhead and has positioned at the free end 663 of the arm 656 a ratchet 662. The arm 656 upon energization of the solenoid 636 is actuated in a counterclockwise direction, as viewed in FIG. 3, about the pin 660 so as to position the ratchet 662 into operative relation with a code post pinion or gear 301 at one end of the code post 260.

Upon de-energization of the solenoid 636, a spring 665 is effective to bias the plunger or rod 654 so as to actuate the code change arm 656 in a clockwise direction, as viewed in FIG. 3, and the rack 662 out of operative relation with the pinion 301.

Thus, upon the code change solenoid 636 being energized by closure of a switch 360, the rack 662 is brought into proper operative relationship with the code change pinion 301 on the code post 260.

Thereafter, the code wheel assembly 38 may be stepped to the next position by momentary closure of the switch 362 whereupon the rack 662 is effective to rotate the pinion 301 and thereby the code post 260 for 180° C. into the next detent position.

Thereafter, the rack 662 may be selectively returned to the null position by the de-energization of the solenoid 636 by the opening of the control switch 360. In the event a code change is not required for any one code post, the code wheel assembly 38 may be merely stepped past to the next position without energization of the code change solenoid 636.

The change in the code remotely, i.e. with a closed decoder unit, can be accomplished only by a person having the knowledge of the difference between the old and new codes. An electrical access to both the driver and code change solenoids is assumed in this operation. At the end of the code change operation, the code wheel assembly 38 may be reset to a home position by the operator closing the reset switch 450 effecting energization of the reset solenoid 452, as heretofore explained.

TRANSFER SWITCH OPERATING MECHANISM

In effecting the operation of the transfer switch 100, shown in FIGS. 1B and 5, there is provided the arm 624 biased by a spring 700, as shown in FIG. 5, into operative engagement with the switch operating button 622. The arm 624 is affixed to a shaft 702, shown in FIGS. 3 and 5 and schematically in FIG. 1B, rotatably mounted in bearings 704 and 706 carried by flange portions 708 and 710, as best shown in FIG. 3. The arm 624 is mounted at the upper end of the shaft 702 while there is connected at the lower end of the shaft 702 an arm 712 engaged by a plate 714 affixed to the end 301A of the last address code post 260A at for example, the 21st bit.

The arrangement is such that, upon actuation of the last address code post 260A in the aforesaid 21st bit position by the knocker arm 135 upon energization of the mark solenoid 130 so as to cause the plate 714 to be actuated outwardly and in turn effect angular adjustment of the arm 712 and the shaft 702 in the direction indicated in FIG. 3 by the arrows, this last-mentioned action then causes the arm 624 to be actuated in a counterclockwise direction, as viewed in FIG. 5, against the biasing force of the spring 700 causing in turn the switch operating button 622 to be operated so as to cause the transfer switch element 616 of FIG. 8 to be operated in a direction opening the switch contact 618 and closing the switch contact 620.

The switch operating arm 624 is locked in the last-mentioned actuated position by the operation of a latching arm 632 shown in FIG. 3, which is then biased under force of a spring 634 into the position indicated by dotted lines. The latching arm 632 has an end portion 636 arranged in cooperative relation with the switch operating arm 624 to effect the aforementioned latching action while the opposite end of the arm 632 is connected to the spring 634 with an intermediate portion of the latching arm 632 being pivotally mounted on the shaft 345. Further, it will be noted that, as shown in FIG. 3, a pin 640 projects from the stop arm 342 into a slot 645 provided in the latching arm 632.

The arrangement is such that, upon the code wheel assembly 38 being step actuated to the last operative position, for example, the 21st bit position, the switch operating arm 624 is effective to actuate the operating button 622 of the transfer switch 100, shown in FIG. 8, so as to transfer the operative connection of the control switch 360 from the mark solenoid 130 to the code change solenoid 636. Such actuation of the transfer switch 100 by the switch actuating arm 624 is then locked in the actuated position by the action of the latching arm 632.

Thereafter, the code wheel assembly 38 may be reset to the start, home, or null position by operation of the reset solenoid 452 causing the pawl 332, as heretofore explained and shown in FIG. 7, to actuate the detent members 316A so as to release the auxiliary code posts 260A, while the transfer switch 100 is held in the last-mentioned actuated position by the latching arm 632 so as to render the code change solenoid 636 effective for selective energization by operation of the switch 360. Thereafter, upon step actuating the code wheel assembly 38 by operation of the space solenoid 232 by control switch 362 and appropriate operation of the code change solenoid 636 by the operation of the control switch 360, the code for unlocking the code wheel assembly 38 may be reset.

However, upon the code wheel assembly 38 being step actuated to the last code setting position, in the example shown, the 16th bit position, in which the pin 49 engages the locking arm 342 and with the code wheel assembly 38 remaining in a locked condition, the stop arm 342 will be actuated by the pin 49 in a counterclockwise direction, as viewed in FIGS. 3 and 4, about the shaft 345 so that the pin 640 carried by the stop arm 342 and positioned in slot 645 of the locking arm 632 then becomes effective to actuate the locking arm 632 in a counterclockwise direction so as to lift it out of locking relation with the arm 624.

Further, upon the arm 632 being so actuated out of locking relation with the arm 624, the spring 700 biases the arm 624 in a clockwise direction, as viewed in FIG. 5, and the shaft 702 in a corresponding clockwise direction opposite to that indicated by the arrows shown in FIGS. 3 and 5, whereupon the switch arm 624 actuates switch operating button 622 and thereby the switch member 616 to a position opening the switch contact 620 and closing the switch contact 618, as shown in FIG. 8.

Thereafter, upon the code wheel assembly 38 returning to the start, home, or null position by the closure of the reset switch 450 and energization of the reset solenoid 452, the code wheel assembly 38 is then ready for operation under the new code conditions set by the operation of the code change solenoid 636, as heretofore explained.

SOLENOID ELECTRICAL AND AUDIBLE NOISE MASKING

The code input information, irrespective of whether each code post 260 has been properly actuated to allow closure of the switch 297 will be stored until the advancing motion of the outer wheel elements 40 and 42 after the 16th bit input is attempted. It can be seen, therefore, that the amount of work expended to move any code post 260 is nominally the same whether actuated by the "mark" or "space" solenoids 130 and 232, respectively. That is to say, the orientation or coding of the code post 260 has no effect on the effort involved in the displacement thereof during decoding, whether a correct or incorrect decoding bit is applied.

In this fashion, the electrical emanation of the solenoids 130 and 232 while not actually masked or eliminated, have no effect on the security problem when considering it in relation to code deduction possibilities. By the same token, since whatever audible noise generated during decoding is always the same for each position of the code posts 260 monitoring the audible noise also yields no code deduction information.

DECODING OPERATION

In performing a decoding operation, the following sequences of operation take place:

a. Advancing or Stepping of Code Wheel Assembly

Solenoid (130 or 232) retracts plunger upon application of power and thereby:

1. Advances pawl (90 or 190) to next position on ratchet wheel 36.

2. Stores energy in code wheel advance spring (120 or 220).

3. Pushes code post 260 through operation of bell crank actuator (135 or 236).

Upon removal of power from the solenoid (130 or 232):

1. Code wheel advance spring (120 or 220) advances code wheel assembly 38 through action of pawl (90 or 190) on ratchet wheel 36.

2. Energy is stored in code wheel return spring 70.

The code wheel assembly 38, while progressing from the first to the 16th bit positions will advance at each actuation whether the code bit inserted is correct or not.

When the 16th position or station of the code wheel assembly 38 has been reached, the inner and outer wheels are still "together".

If the code input has been correct:

1. The inner wheel 48 and outer wheel elements 40–42 still maintain the same position relative to each other.

2. No code posts 260 are engaged in grooves 267 of the inner wheel element 48 and the outer wheel elements 40–42 are mechanically free of the inner wheel element 48.

3. The pin 49 of the inner wheel element 48 is normally against the stop arm 342.

4. No operation of the control switch 297 has taken place.

5. The outer wheel elements 40–42 are now in condition for further advance so that the auxiliary code post 260A in the 17th position may be selectively actuated so as to effect the operation of the switch 297. Thus, upon the code post 260A being actuated longitudinally to the left, as viewed in FIG. 2, by energization of the "space" solenoid 232 and resulting actuation of the knocker arm 236, the code post 260A remains in unlocking relation with the inner wheel 48 whereupon the outer wheel elements 40 and 42 may be angularly positioned against the opposing force of the coupling spring 50 without imparting an angular movement to either the inner wheel element 48 or the second inner wheel element 280. Thus, the pin 290 projecting from the second inner wheel element 280 and through the slot 292 will not impart an angular movement to the switch mechanism 400 or adjust the same relative to the switch arms 413 and 414. However, upon the selective actuation of one or the other of the code posts 260A in the 17th, 18th, 19th, 20th, or 21st step positions by energization of the "mark" solenoid 130 as distinguished from the "space" solenoid 232 in one or the other of these positions causing the actuation of the corresponding code posts 260A to the right effecting locking engagement of the flange 273A in the detent portion 283 of the arm 282 of the second inner wheel element 280, the second inner wheel element 280 will in effect be locked to the outer wheel element 42 in a position in the slot 292 corresponding to the angular adjusted position of the outer wheel element 42 relative thereto upon the selective actuations thereof. The second inner wheel 280 being then locked to the outer wheel element 42 will cause the arm 295 of the switch mechanism 400 to effect angular adjustment of the switch mechanism 400 relative to the switch arms 413–414 in response to the angular movement of the outer wheel element 42.

6. Thereafter, the angular adjustment of the qualifying switch structure 370 being keyed to the shaft 34 will render the selected switch of the switch mechanism 400 effective upon the outer wheel elements 40–42 being angularly adjusted to the 21st step position in which the selected switch segments 409 and 411 will cooperate with the respective switch arms 413 and 414 to close an energizing circuit through the corresponding qualifying switch segments 381 and 383 and cooperating switch arms 385–387 to close a selected circuit for the control devices 421–425 to effect the desired operation.

7. Furthermore, upon the actuation of the code wheel assembly 38 to the 21st bit position, it will be seen that the actuation of the code post 260A in this position longitudinally to the right as viewed in FIG. 2 by the energization of the "mark" solenoid 130 and the resulting actuation of the knocker arm 135 will cause the plate 714 attached to the code post 260A to operate the arm 712, shaft 702, and control arm 624, as shown in FIGS. 3 and 5, so as to cause operation of the switch button 622 of the transfer switch 100, shown diagrammatically in FIG. 8, to cause a switch arm 616 to open the contact 618 and close another contact 620 rendering the code change solenoid 636 effective upon closure of the switch 360.

8. Upon return of the code wheel assembly 38 to the start, home, or null position by the operation of the reset switch 450, as heretofore explained, the transfer switch 100 remains in the last-mentioned actuated position due to the locking action of the arm 632 on the control arm 624 whereupon the code for unlocking the code wheel assembly 38 may be reset by the selective operation of the solenoid 636 by operation of the control switch 360.

9. Upon completion of a change in the code for unlocking the code wheel assembly 38, the code wheel assembly 38 may once again be returned to the start, home or null position by the operator closing the reset switch 450 whereupon the mechanism is then effective for another decoding operation and the selective operation of another of the control devices 421–425 as desired and heretofore explained.

If the code input has not been correct:

1. Any number of the code posts 260 at the 16th bit position would then remain still engaged in the grooves 267 of the inner wheel element 48.

2. The inner wheel element 48 and the outer wheel elements 40–42 maintain their relative positions to each other in steps 1–16.

3. The arm 49 of the inner wheel element 48 is then normally against the stop arm 342.

4. No selective operation of the control switch mechanism 297 is then possible.

5. The outer wheel elements 40–42 are locked against further advance and actuation of the stop arm 342 effects operation of the counter mechanism 350.

6. Thereafter, return of the code wheel assembly 38 to the start, home, or null position may be effected by the operator closing the reset switch 450 whereupon the solenoid 452 is energized and the pick-up mechanism is effective to lift the pawls 90 and 190 out of operative engagement with the ratchet wheel 36 whereupon the same may be returned under the biasing force of the spring 70 to the start, home, or null position.

7. After a predetermined number of cycles of unsuccessful attempts to operate the decoding mechanism, the counter mechanism 350 of FIG. 4 is then effective upon the deep control slot 545 coinciding with the roller 544 to cause the linkage mechanism 565 under the biasing force of the spring 566 to actuate the clutch jaw 580 into engaging relation with the clutch jaw 586 of FIG. 5.

8. Thereafter upon the operator closing the reset switch 450, the reset solenoid 452 is rendered effective through the linkage 600 to wind the spring of the timer mechanism 352 whereupon the limit switch elements 596 and 598 will be actuated to an open circuit position in which the switch mechanisms 360 and 362 will be ineffective for effecting the stepping operation of the code wheel assembly. The energization of the reset solenoid 452 will also be effective to lift the pawls 90 and 190 out of operating relation with the stepper wheel 36 so that the spring 70 may return the code wheel assembly 38 to the home, start, or null position.

9. After a predetermined time interval, the timer spring of the mechanism 352 will become unwound whereupon the limit switch elements 596 and 598 will be closed and switches 360 and 362 will again be effective to control the stepping and unlocking operation of the code wheel assembly 38, as heretofore explained.

While only one embodiment of the invention has been illustrated and described, various changes in the form and relative arrangement of the parts, which will now appear to those skilled in the art may be made without departing from the scope of the invention. Reference is, therefore, to be had to the appended claims for a definition of the limits of the invention.

What is claimed is:

1. A mechanism comprising a base member, a shaft supported by the base member, a code wheel assembly including a first element, a second element and a third element, said elements being carried by the shaft, a plurality of main code posts carried by said first element and preset for locking the first element and the second element in driving relation, selectively operable means carried by the base member for actuating the main code posts sequentially in a predetermined sense for unlocking the second and first elements, an auxiliary code post carried by said first element and operable by said selectively operable means for locking the first element to the third element following the actuation of the main code posts sequentially in said predetermined sense to unlock the first and second elements, control means selectively actuated by the third element for performing a control function, and said control means being selectively actuated by said third element following the locking of the first element to the third element by the auxiliary code post and after the first element has been unlocked from the second element.

2. A mechanism comprising a base member, a shaft supported by the base member, a rotatable code wheel assembly including a first wheel element, a second wheel element and a third wheel element, said elements being carried by the shaft, a plurality of main code posts slidably mounted in the first wheel element and cooperatively arranged for locking the second wheel element to the first wheel element, a plurality of auxiliary code posts slidably mounted in the first wheel element for locking the third wheel element to the first wheel element, means carried by the base member for selectively actuating the main code posts in a predetermined sense for unlocking the first wheel element from the second wheel element, and said actuating means being effective after the unlocking of the first wheel element from the second wheel element by the selective action of the main code posts in said predetermined sense to thereafter selectively actuate one of the auxiliary code posts in another predetermined sense to lock the first wheel element to the third wheel element for angularly positioning the third wheel element relative to the second wheel element for effecting a control function.

3. The combination defined by claim 2 in which said actuating means includes motor means carried by the base member for selectively actuating each of the main and auxiliary code posts in said predetermined unlocking and locking senses, and other means conditioned by operation of said motor means for effecting a step actuation of the code wheel assembly upon completion of the selected actuation of each of said code posts in said predetermined senses.

4. A mechanism comprising a base member, a shaft supported by the base member, a rotatable code wheel assembly including a first wheel element, a second wheel element, and a third wheel element, said elements being carried by the shaft a first coupling spring drivingly connected the first wheel element to the second wheel element, a second coupling spring drivingly connecting the second wheel element to the third wheel element, a plurality of main code posts for locking the second wheel element to the first wheel element in driving relation, a plurality of auxiliary code posts for locking the third wheel element to the first wheel element in driving relation, a pair of actuating means carried by the base member for selectively actuating the main code posts in opposite senses and thereafter for selectively actuating the auxiliary code posts in opposite senses, said main code posts including preset actuatable means for unlocking the second wheel element from the first wheel element dependent upon the selected sense of actuation of the main code posts by said actuating means, said auxiliary code posts including means for locking the third wheel element to the first wheel element dependent upon the selected sense of actuation of the auxiliary code posts by said actuating means, and means operably connecting the third wheel element for effecting a control function upon the first wheel element being first unlocked from the second wheel element upon completion of a predetermined decoding sequence of operation of said actuating means and thereafter said first wheel element being locked to the third wheel element upon the selected operation of said auxiliary code posts in said locking sense.

5. The combination defined by claim 4 including motor means carried by the base member and operatively connected to said pair of actuating means for selectively actuating each of said code posts in locking and unlocking senses, other means conditioned by operation of said motor means for effecting a step actuation of the code wheel assembly upon completion of the selected actuation of each code post, said second wheel element including means operable thereby to limit the step actuation of the code wheel assembly upon the decoding sequence of operation of said actuating means failing to unlock the second wheel element from the first wheel element and thereby preventing the first wheel element from being locked to the third wheel element for effecting the controlled function.

6. An electromechanical decoder comprising a base member, a shaft supported by the base member, a code wheel assembly, a ratchet wheel and a pair of actuating pawls cooperating therewith to rotatably position the code wheel assembly in a step action, said code wheel assembly and ratchet wheel being carried by the shaft, a pair of solenoids carried by the base member, said solenoid being selectively operable for actuating each of said pawls relative to said ratchet wheel, a spring conditioned by the operation of each solenoid and effective to cause each pawl to step actuate the ratchet wheel and thereby the code wheel assembly to a second adjusted position under the biasing force of said spring upon de-energization of the selected solenoid, the other of said pawls being arranged to maintain the ratchet wheel and thereby the code wheel assembly in a fixed position until de-energization of the selectively actuated solenoid renders the spring effective, the code wheel assembly including an outer wheel element and first and second inner wheel elements, said outer wheel element and said inner wheel elements being carried by the shaft, first means for locking the first inner wheel element to the outer wheel element in driving relation, second means for locking the second inner wheel element to the outer wheel element in driving relation, means selectively operable by the solenoids for first actuating said first locking means in locking an unlocking senses dependent upon the selection of the actuating solenoid, said selectively operable means being thereafter effective upon the first inner wheel element being unlocked from the outer wheel element for effecting actuation of said second locking means in a sense to lock the second inner wheel element to the outer wheel element dependent upon the selection of the actuating selenoid, and means operable by the second inner wheel element for effecting a control function upon the outer wheel element being locked to the second inner wheel element.

7. The combination defined by claim 6 in which the first inner wheel element includes means operable thereby for limiting the rotatable positioning of the code wheel assembly upon the first inner wheel element being maintained in a locking relation with the outer wheel element upon completion of a decoding sequence of operation so as to thereafter prevent said second inner wheel element from being locked to said outer wheel element by said second locking means.

8. For use with a pair of electrical circuits which may be energized one circuit at a time in any sequential order, an apparatus for determining if said circuits are energized in a predetermined order, said apparatus comprising a base member, a shaft supported by the base member, a code wheel supported by the shaft and including actuatable means for storing said predetermined order therein, means defining a start position for said code wheel, spring means for biasing said code wheel toward said start position, a ratchet wheel carried by said shaft and drivingly connected to said code wheel, pawl means, motor means selectively operated by said circuits for operating said pawl means, said pawl means being normally in an operative relation with said ratchet wheel for rotating said ratchet wheel and said code wheel in a direction opposed to said spring means, means selectively operable by said motor means for actuating said storing means in said code wheel, other means selectively operable by said motor means upon the actuation of said storing means being in said predetermined order, and control means operable by said other means dependent upon the selective operation of said other means.

9. The combination defined by claim 8 including limiting means operable by said code wheel upon actuation of said storing means being in an order other than said predetermined order for rendering said other means ineffective for selective operation by said motor means.

10. The combination defined by claim 9 in which the storing means in said code wheel includes a plurality of main code posts operable by said selectively actuating means, and said other means includes a plurality of auxiliary code posts selectively operable by said selectively operable actuating means upon the actuation of said main code posts of said storing means being in said predetermined order.

11. A mechanism comprising a base member, a shaft supported by the base member, a code wheel assembly including a first wheel element, a second wheel element, and a third wheel element, said wheel elements being carried by said shaft, a plurality of main code posts carried by the first wheel element and preset for locking the first and second wheel elements in driving relation, a plurality of auxiliary code posts carried by the first wheel element and arranged for actuation to a position for locking the first and third wheel elements in driving relation, selectively operable means for carried by the base member for actuating the main code posts and thereafter the auxiliary code posts sequentially in opposite senses, means for releasably locking the main and auxiliary code posts in the actuated senses, said main code posts being effective for unlocking the first and second wheel elements upon completion of the actuation thereof in a predetermined order and sense, said auxiliary code posts being effective for locking the first and third wheel elements upon actuation of one of said auxiliary code posts in a predetermined sense, and means actuated by the third wheel element for performing a control function upon the first wheel element being unlocked from the second wheel element and thereafter locked to the third wheel element.

12. A mechanism comprising a base member, a shaft supported by the base member, a code wheel assembly including a first wheel element, a second wheel element, and a third wheel element, said wheel elements being carried by said shaft, a plurality of main code posts carried by the first wheel element and preset for locking the first and second wheel elements in driving relation, a plurality of auxiliary code posts carried by the first wheel element and arranged for locking the first and third wheel elements in driving relation upon actuation thereof in one sense, selectively operable means carried by the base member for actuating the main code posts and thereafter the auxiliary code posts sequentially in opposite senses, first spring means for coupling the first wheel element to the second wheel element, and second spring means for coupling the second wheel element to the third wheel element, means to step actuate the first wheel element so as to sequentially position the main code posts and thereafter the auxiliary code posts for actuation by said selectively operable actuating means, means conditioned by the selectively operable actuating means for operating the step actuator means, means for releasably locking the main and auxiliary code posts in the actuated sense, said main code posts being effective for unlocking the first and second wheel elements upon completion of the actuation of the code posts in a predetermined order and sense, control means operatively positioned so as to raise said step actuating means out of operative relation with said first wheel element, means for biasing said code wheel assembly to a start position, said control means being actuated by said second wheel element upon completion of the actuation of said code posts in an order and sense other than as so predetermined so as to raise said step actuating means out of operative relation with said first wheel element and thereby render said biasing means effective to return the code wheel assembly to the start position, reset means for releasing said main and auxiliary code post locking means, and said reset means being operable in response to reverse rotation of the code wheel assembly to release said auxiliary code post locking means and to release said main code post locking means upon the code wheel assembly approaching the start position under the force of said biasing means.

13. The combination defined by claim 12 in which said reset means includes a disc carried by the shaft and concentrically mounted relative to the code wheel assembly, and the locking means includes pivotal members carried by the first wheel element for releasably locking the code posts in the actuated sense, pivotal pawl means operable to actuate the locking members for the auxiliary code post so as to release the auxiliary code post in response to the reverse rotation of the code wheel assembly, said disc having a plurality of peripheral indented portions therein cooperating with the locking members for the main code posts, a spring drivingly coupling the disc to the first wheel element, and the disc having an arm operable by the control means for angularly moving the disc relative to the first wheel element to actuate the locking members so as to release the code post upon the code wheel assembly approaching the start position under force of said biasing means.

14. A mechanism comprising a base member, a shaft supported by the base member, a code wheel assembly including a first wheel element, a second wheel element, and a third wheel element, said wheel elements being carried by said shaft, said shaft being drivingly connected to the first wheel element, a plurality of code posts carried by the first wheel element and preset for locking the first and second wheel elements in driving relation, a plurality of auxiliary code posts carried by the first wheel element and arranged for locking the first and third wheel elements in driving relation upon actuation of one of the auxiliary code posts in a predetermined sense, a first spring for coupling the first wheel element to the second wheel element, a second spring for coupling the second wheel element to the third wheel element, selectively operable means carried by the base member for actuating the main and auxiliary code posts sequentially in opposite senses, a ratchet wheel operatively connected to said shaft, pawl means operated by said selectively operable means for rotating said ratchet wheel so as to position said code wheel assembly for said sequential actuation of the main and auxiliary code posts, means for releasing the main and auxiliary code posts in the actuating sense, said main code posts being effective for unlocking the first and second wheel elements upon completion of the actuation of said main code post in a predetermined order and sense, means for limiting the angular movement of the second wheel element upon the completion of the actuation of said main code post in said predetermined order and sense, and control means selectively operable by the third wheel element upon one of said auxiliary code posts being actuated in a sense locking said third wheel element to said first wheel element so as to effect angular movement of said third wheel element after the first wheel element has been unlocked from the second wheel element by actuation of said main code post in a predetermined order and sense.

15. A mechanism comprising a base member, a shaft supported by the base member, a code wheel assembly including a first wheel element, a second wheel element and a third wheel element, said wheel elements being carried by said shaft, said shaft being drivingly connected to the first wheel element, a plurality of main and auxiliary code posts carried by said first wheel element, the main code posts being preset for locking the first and second wheel elements in driving relation, a first spring for coupling the first wheel element to the second wheel element, a second spring for coupling the second wheel element to the third wheel element, selectively operable means carried by the base member for actuating the main and auxiliary code posts sequentially in opposite senses, a ratchet wheel operatively connected to said shaft, pawl means operative by said selectively operable means to step actuate said ratchet wheel so as to position said code wheel assembly for said sequential actuation of said main and auxiliary code posts, the plurality of auxiliary code posts carried by said first wheel element being arranged to lock the first and third wheel elements in driving relation upon actuation of the auxiliary code posts in a predetermined sense, means for releasably locking the main and auxiliary code posts in an actuated sense, said main code posts being effective for unlocking the first and second wheel elements upon completion of the actuation of said main code posts in a predetermined order and sense, means for limiting angular movement of the second wheel element on said shaft upon the completion of the actuation of said main code posts in said predetermined order and sense, control means selectively operable by said third wheel element upon angular movement of the third wheel element relative to said second wheel element upon the first wheel element being unlocked from the second wheel element and angular movement of said second wheel element being prevented by said limiting means, said main code posts being effective for maintaining the first and second wheel elements in a locked relation upon completion of the actuation of said main code posts in an order and sense other than as predetermined so as to prevent the selective operation of said control means by said third wheel element, means operable for lifting said pawl means from operative relation with said ratchet wheel upon the first wheel element being maintained in a locked relation with the second wheel element, and return spring means being effective upon the lifting of the pawl means from operative relation with said ratchet wheel for biasing the shaft to a start position.

16. The combination defined by claim 15 including first reset means for releasing the locking means for the auxiliary code posts upon initiation of the return of the code wheel assembly to the start position, and second reset means for releasing the locking means for the main code posts, said second reset means being operable by the pawl lifting means upon the code wheel assembly being biased to said start position by said return spring means.

17. For use with a pair of electrical circuits that may be energized one circuit at a time in any sequential order, an apparatus for determining if such circuits are energized in a predetermined order, the apparatus comprising a base member, a shaft supported by the base member, a code wheel assembly supported by the shaft and having means for storing said predetermined order therein including a plurality of main code posts, said main code posts including adjustable means for setting the predetermined order, said code wheel assembly including a plurality of auxiliary code posts, actuating means carried by the base member and electrically operated by said circuits for sequentially actuating said main code posts and said auxiliary code posts in said code wheel assembly, and control means operable by said auxiliary code posts after the actuation of said main code posts in the predetermined order set by the adjustable means of said main code posts.

18. For use with a pair of electrical circuits which may be energized one circuit at a time in any sequential order, an apparatus for determining if such circuits are energized in a predetermined order, the apparatus comprising a first wheel element, a shaft drivingly connected to the first wheel element, stop means defining a start position for said first wheel element, a first spring for biasing said first wheel element toward said start position, a second wheel element freely movable on said shaft, a third wheel element being movable on said shaft, a second spring for drivingly coupling the first wheel element to the second wheel element, a third spring for drivingly coupling the second wheel element to the third wheel element, a plurality of main code posts slidably mounted in said first wheel element and preset in an initial position for locking the first and second wheel elements in direct driving relation, said main code posts being arranged in said first wheel element so as to cooperate with said second wheel element upon actuation of the main code posts in a predetermined sense to disconnect the second wheel element from locking relation with the first wheel element, and each of said main code posts being so arranged that upon actuation in an opposite sense such main code posts remain in a locking relation with the first and second wheel elements, said first wheel element including resilient means for biasing each of the code posts to said initial locking position between the first and second wheel elements, a plurality of auxiliary code posts slidably mounted in said first wheel element, said auxiliary code posts being preset in said first wheel element in an initial position for effecting an unlocking relation between the first and third wheel elements and so arranged as to cooperate with said third wheel element upon actuation of the auxiliary code posts in another predetermined sense so as to lock the first and third wheel elements in direct driving relation, and each of said auxiliary code posts being so arranged that upon actuation in an opposite sense such auxiliary code posts remain in an unlocking relation with the first and third wheel elements, knocker arm means carried by the base member and operatively mounted at opposite ends of the first wheel element for selectively actuating the main and auxiliary code posts, and motor means carried by the base member and selectively energized by the aforesaid pair of electrical circuits for operating said knocker arm means so as to cause said main code posts to be actuated in a sense to unlock the first and second wheel elements upon said circuits being energized in said predetermined order and thereafter to selectively actuate said auxiliary code posts so as to effectively lock the first wheel element to the third wheel element, control means selectively operable by the third wheel element, and the third wheel element being drivingly connected to the first wheel element by operation of the auxiliary code posts in said other predetermined sense.

19. A decoding mechanism comprising a base member, a shaft supported by the base member, a code wheel assembly including a first element, a second element, and a third element, said elements being carried by said shaft, main code post means carried by the first element and normally positioned for locking the first and second elements in driving relation, selectively operable means carried by the base member for actuating the main code post means in a predetermined sense for unlocking the first and second elements, auxiliary code post means carried by the first element and effective upon the first and second elements being in an unlocked relation, said auxiliary code post means being operable by said selectively operable means in one sense for locking said first and third elements and in another sense to retain said first and third elements in said unlocked relation, and means actuated by the third element for performing a control function upon the first element being locked in driving relation with the third element by the selective operation of the auxiliary code post means in said one sense.

20. The combination defined by claim 19 in which the main code post means may be selectively adjusted so as to change the predetermined senses of actuation for effecting the unlocking of the first and second wheel elements, and means for selectively adjusting said main code post means rendered effective upon completion of an operation of the code wheel assembly.

21. A decoder mechanism comprising a base member, a shaft supported by the base member, a rotatable wheel assembly including a first wheel element, a second wheel element, and a third wheel element, said wheel elements being carried by said shaft, a plurality of main code posts slidably mounted in the first wheel element for locking the first wheel element to the second wheel element, means carried by the base member for selectively actuating the main code post means to unlock the first wheel element from the second wheel element, auxiliary code post means slidably mounted in the first wheel element and effective upon the first and second wheel elements being in an unlocked relation to be actuated so as to lock the third wheel element to the first wheel element, said auxiliary code post means being selectively operable by said actuating means in one sense for locking said second and third wheel elements and in another sense to retain said first and third wheel elements in an unlocked relation, and control means selectively operable by said third wheel element dependent upon the auxiliary code post means.

22. The combination defined by claim 21 including motor means carried by the base member for selectively actuating each of the main and auxiliary code post means in said locking and unlocking senses, other means conditioned by operation of said motor means for effecting the step actuation of the wheel assembly upon completion of each of the selective actuations of said main and auxiliary code posts, and control means jointly positioned by said motor means through said rotatable wheel assembly and said third wheel element upon the locking of the first wheel element to the third wheel element.

23. A decoder mechanism comprising a base member, a shaft supported by the base member, a rotatable wheel assembly including a first wheel element, a second wheel element, and a third wheel element, said wheel element being carried by said shaft, a primary code post carried by the first wheel element and normally positioned so as to lock the second wheel element to the first wheel element in driving relation, a secondary code post carried by the first wheel element and normally positioned in unlocking relation between the first and third wheel elements, a pair of actuating means carried by the base member for selectively operating the primary and secondary code posts in opposite senses, said primary code post including a preset adjustable means for unlocking the second wheel element from the first wheel element dependent upon the selected sense of actuation of the primary code post by said actuating means, said secondary code post including means for locking the third wheel element to the first wheel element dependent upon the selected sense of actuation of the secondary code post by said actuating means, and means operably connected to the third wheel element for effecting a control function after the first wheel element has been unlocked from the second wheel element and the third wheel element has been locked to the first wheel element upon completion of a predetermined decoding sequence of operation of said primary and secondary code posts by said actuating means.

24. A decoder mechanism comprising a base member, a shaft supported by the base member, a code wheel assembly including a first wheel element, a second wheel element, and a third wheel element, said wheel elements being carried by said shafts, a plurality of main code posts carried by the first wheel element and preset for locking the first and second wheel elements in driving relation, selectively operable means carried by the base member for actuating the main code posts sequentially in opposite senses, means for releasably locking the main code posts in the actuated senses, said main code posts being effective for unlocking the first and second wheel elements upon completion of the actuation thereof in a predetermined order and sense, a plurality of auxiliary code posts carried by the first wheel element and preset in an unlocking relation with the first and third wheel elements, said selectively operable means being effective for actuating the auxiliary code posts sequentially in opposite senses upon the first and second wheel elements being unlocked by the aforesaid actuation of the main code posts in said predetermined order and sense, said auxiliary code posts being effective for locking the first and second wheel elements upon actuation of one of said auxiliary code posts in a predetermined locking sense, and said auxiliary code posts being effective for retaining the first and third wheel elements in a locking relation upon actuation thereof in a predetermined unlocking sense, and means actuated by the third wheel element for providing a control function upon the first wheel element being first unlocked from the second wheel element and the third wheel element being thereafter locked to the first wheel element upon completion of the actuation of said main and auxiliary code posts in a predetermined order and sense.

25. A decoder mechanism comprising a code wheel assembly including a first wheel element, a shaft drivingly connected to the first wheel element, a second wheel element and a third wheel element freely mounted on said shaft, a plurality of code posts carried by said first wheel element and preset for locking the first and second wheel elements in driving relation, a first spring for coupling the first wheel element to the second wheel element, a second spring for coupling the second wheel element to the third wheel element, a pair of selectively operable means for actuating the code posts sequentially in opposite senses, a ratchet wheel operatively connected to said shaft, pawl means operated by said selectively operable means for rotating said ratchet wheel so as to position said code wheel assembly for said sequential actuation of the code posts, means for releasably locking the code posts in said opposite actuated senses, said code posts being effective for unlocking the first and second wheel elements upon completion of the actuation of said code posts in a predetermined order and sense, means for limiting the angular movement of the second wheel element relative to the shaft upon the completion of actuation of said code posts in said predetermined order and sense, control means thereafter operable by the third wheel element upon angular movement of said third wheel element relative to said second wheel element, other means selectively operable for connecting the third wheel element to the first wheel element for effecting the angular movement of said third wheel element relative to said second wheel element, said code posts being effective for retaining the first and second wheel elements in a locked relation upon completion of actuation of said code posts in an order and sense other than as predetermined so as to prevent the operation of said control means by said third wheel element, means for lifting the pawl means from operative relation with said ratchet wheel, and spring means being effective upon the lifting of the pawl means for returning the code wheel assembly and shaft to a start position.

26. The combination defined by claim 25 including first reset means for actuating said connecting means in a sense to disconnect said third wheel element from said control means upon a reverse movement of the code wheel assembly, and second reset means for releasing the means for locking the code posts, and said second reset means being operable upon the code wheel assembly being biased toward said start position by said spring means.

27. For use with a pair of electrical circuits that may be energized one circuit at a time in any sequential order, an apparatus for determining if said circuits are energized in a predetermined order, the apparatus comprising a base member, a shaft supported by the base member, a code wheel assembly carried by the base member and having means for storing said predetermined order therein including a plurality of code posts, said code posts including adjustable means for setting the predetermined order, selectively operable means for actuating said adjustable means so as to change the setting of at least one of said code posts and thereby said predetermined order of energization of said circuits, actuating means carried by the base member and electrically operated by said circuits for actuating said code posts, means operable by said code wheel assembly for effecting a control function upon the actuation of said code post being in said predetermined order, said control means being operable by said code wheel assembly upon the actuation of said code posts in said predetermined order, and said control means being effective upon the operation thereof to render one of said pair of electrical circuits effective for operating said means for actuating the adjustable means so as to change the setting of at least one of said code posts and thereby said predetermined order of energization of said circuits.

28. The combination defined by claim 27 including other means effective to render said control means inoperative upon completion of a predetermined cycle of actuation of the code wheel assembly to change the predetermined order of energization of said circuits.

29. A mechanism comprising a base member, a shaft supported by the base member, a rotatable code wheel assembly including a first wheel element, a second wheel element, and a third wheel element, said wheel elements being carried by said shaft, a plurality of code posts carried by the first wheel element and normally positioned so as to lock the second wheel element to the first wheel element in driving relation, a pair of actuating means carried by the base member and arranged to selectively operate the code posts in opposite senses, said code posts including preset means for unlocking the second wheel element from the first wheel element dependent upon the selected sense of actuation of the code posts by said actuating means, each of said code posts including adjustable means for angularly positioning said preset means from a first locking position to a second locking position to change the sense of actuation of said actuating means to effect the unlocking of the second wheel element from the first wheel element, means selectively operable by said actuating means to drivingly connect the first wheel element to the third wheel element upon the first wheel element being first unlocked from the second wheel element upon completion of a predetermined sequence of operation of said actuating means, other means for actuating the adjustable means for at least one of said code posts, and control means operable by said actuating means upon completion of a predetermined sequence of operation thereof to render said other means effective for actuating the adjustable means.

30. A mechanism comprising a base member, a shaft supported by the base member, a rotatable code wheel assembly including a first wheel element, a second wheel element, and a third wheel element, said wheel elements being carried by said shaft, a plurality of main code posts carried by the first wheel element and normally positioned to lock the second wheel element to the first wheel element in driving relation, a plurality of auxiliary code posts carried by the first wheel element and normally positioned so as to unlock the first wheel element from the third wheel element, a pair of actuating means carried by the base member for selectively operating the main and auxiliary code posts in opposite senses, said main code posts including preset means for unlocking the second wheel element from the first wheel element dependent upon the selected sense of actuation of the main code posts by said actuating means, said auxiliary code post including means for locking the third wheel element to the first wheel element dependent upon the selected sense of actuation of the auxiliary code posts by said actuating means, each of said main code posts including adjustable means for angularly positioning said preset means from a second position to a first position to change the sense of actuation of the main code posts by said actuating means to effect the unlocking of the second wheel element from the first wheel element, means operably connected to the third wheel element for effecting a control function upon the first wheel element being first unlocked from the second wheel element and thereafter locked to the third wheel element upon completion of a predetermined sequence of operation of said actuating means, and means rendered effective upon the completion of said predetermined sequence of operation of said actuating means for selectively actuating the adjustable means of each of said main code posts so as to change the predetermined sequence of operation of said actuating means.

31. A decoding mechanism comprising a base member, a shaft supported by the base member, a rotatable code wheel assembly including a first wheel element and a second wheel element, said wheel elements being carried by said shaft, a plurality of code posts carried by the first wheel element and normally positioned so as to lock the second wheel element to the first wheel element in driving relation, a pair of actuating means carried by the base member for selectively operating the code posts in opposite senses, said code posts including preset means for unlocking the first wheel element from the second wheel element dependent upon the selected sense of actuation of said code posts by said actuating means, each of said code posts including an adjustable means for angularly positioning said preset means from a first operative position to a second operative position, means operably connected to the first wheel element for effecting a control function upon the first wheel element being unlocked from the second wheel element upon completion of a predetermined decoding sequence of operation of said actuating means, means for actuating the adjustable means of said code posts so as to position the preset means of at least one of the code posts from said first operative position to said second operative position to change the predetermined sequence of operation of said code posts, operator-operative means for actuating the adjustable means of said code posts, and means for rendering said operator-operative means effective upon completion of a predetermined decoding sequence of operation of said actuating means.

32. The combination defined by claim 31 including reset means for rendering the operator-operative means ineffective upon completion of another predetermined cycle of operation of said code posts.

33. For use with a pair of electrical circuits that may be energized one circuit at a time in any sequential order, an apparatus for determining if said circuits are energized in a predetermined order, said apparatus comprising a base member, a shaft supported by the base member, a code wheel supported by the shaft and including adjustable means for storing said predetermined order therein, means for defining a start position for said code wheel, spring means for biasing said code wheel toward said start position, a ratchet wheel carried by said shaft and drivingly connected to said code wheel, pawl means, motor means selectively operated by said pair of circuits for operating said pawl means, said pawl means being normally in an operative relation with said ratchet wheel for rotating said reset wheel and said code wheel in a direction opposed to said spring means, means selectively operably by said motor means for actuating said storing means in said code wheel, means operable by said code wheel for effecting a control function upon the actuation of said storing means being in said predetermined order, other means for angularly adjusting said storing means so as to set said predetermined order, and means to render said other means effective upon completion of a cycle of actuation of said storing means in said predetermined order.

34. The combination defined by claim 33 including reset means for rendering said other means ineffective upon completion of the angular adjustment of said adjustable means during another predetermined cycle of actuation of said storing means.

35. For use with a pair of electrical circuits energized one circuit at a time in any sequential order, an apparatus for determining if said circuits are energized in a predetermined order, said apparatus comprising a base member, a shaft supported by the base member, a code wheel supported by the shaft and including adjustable means for storing said predetermined order therein, means defining a start position for said code wheel, spring means for biasing said code wheel toward said start position, a ratchet wheel carried by said shaft and drivingly connected to said code wheel, pawl means, motor means selectively operated by said pair of circuits for operating said pawl means, said pawl means being normally in an operative relation with said ratchet wheel for rotating said ratchet wheel and said code wheel in a direction opposed to said spring means, means operable by said code wheel for effecting a control function upon said storing means being actuated in said predetermined order, timing means for rendering the apparatus inoperative for a predetermined interval of time, and cycle counting means driven by said code wheel for rendering said timing means effective upon completion of a predetermined number of unsuccessful cycles of operation of said apparatus.

36. In a mechanism of a type including a pair of electrical circuits that may be energized one circuit at a time in any sequential order, an apparatus for determining if such circuits are energized in a predetermined order, said apparatus comprising a base member, a shaft supported by the base member, a code wheel supported by the shaft and including adjustable means for storing said predetermined order therein, means defining a start position for said code wheel, spring means for biasing said code wheel toward said start position, a ratchet wheel carried by said shaft and drivingly connected to said code wheel, pawl means, motor means selectively operated by said pair of circuits for operating said pawl means, said pawl means being normally in an operative relation with said ratchet wheel for rotating said ratchet wheel and code wheel in a direction opposed to said spring means, means selectively operated by said motor means for actuating said storing means in said code wheel, means operable by said code wheel for effecting a control function upon the actuation of said storing means in said predetermined order, other means for actuating said adjustable storing means so as to change said predetermined order, operator-operative means for lifting said pawl means out of operative relation with said ratchet wheel so as to permit return of the code wheel to the start position under the biasing force of said spring means; the improvement comprising a control means drivingly connected to said code wheel, and means operatively connecting said control means between one of said pair of electrical circuits and said other means so as to render said one electrical circuit effective to operate said other means for actuating said adjustable storing means to change said predetermined order.

37. In a decoder mechanism of a type having a predetermined code setting, the combination comprising means for varying the code setting of the mechanism, and means operably controlled by the mechanism for rendering the code varying means effective upon completion of a predetermined cycle of operation of the decoder mechanism.

38. The combination defined by claim 37 including means for rendering the code varying means ineffective upon completion of a code setting cycle.

39. In a decoder mechanism having a predetermined code setting, means for cyclically limiting operation of the decoder mechanism for a predetermined time interval comprising a timer, counting means operable by the decoder mechanism to render the timer effective after a predetermined plurality of cycles of unsuccessful attempts to operate the decoder mechanism.

40. The combination defined by claim 39 including means for varying the code setting of the decoder mechanism, and means operable by the decoder mechanism for rendering the code varying means effective upon completion of a predetermined cycle of operation of the decoder mechanism.

41. The combination defined by claim 40 including means operable by the decoder mechanism for rendering the code varying means ineffective upon completion of a code setting cycle.

42. A decoder mechanism comprising a base member, a shaft supported by the base member, a first element, a second element, and a third element, said elements being carried by the shaft a plurality of members carried by the first element for locking the first element and the second element in driving relation, selectively operable means carried by the base member for actuating the locking members in a predetermined sense for unlocking the first and second elements, an auxiliary member carried by said first element and operable by said selectively operable means for selectively locking the first element to the third element following actuation of the locking members sequentially in said predetermined sense to unlock the first and second elements, control means selectively actuated by the third element for performing a control function, and said control means being selectively actuated by said third element following the selective locking of the first element to the third element by the auxiliary member and after the unlocking of the first element and the second element.

43. A mechanism comprising a base member, a shaft supported by the base member, a code wheel assembly including a first element and a second element, said elements being carried by the shaft, a plurality of main code posts carried by the first element and preset for locking the first element and second element in driving relation, selectively operable means carried by the base member for actuating said main code posts sequentially and in a predetermined sense for unlocking the first and second elements, a control element, a plurality of auxiliary code posts carried by the first element and actuatable by said operable means in a predetermined sense to selectively connect the first element in driving relation to the control element following the actuation of the main code posts sequentially in said predetermined sense to unlock the first and second elements, means for releasably locking the main and auxiliary code posts in the actuated senses, reset means for releasing said main and auxiliary code post locking means, and said reset means including means operable upon the code wheel assembly approaching the start position for releasing said main code post locking means, and said reset means including other means for releasing the auxiliary code post locking means upon initiation of the return of the code wheel assembly to said start position.

44. The combination defined by claim 43 in which said other means includes a pivotal pawl, a stop member and spring means for biasing said pawl into contacting relation with said stop member, said stop member being operative to render the pawl effective to actuate said auxiliary code post locking means so as to release the auxiliary code posts upon rotation of the code wheel assembly in one sense, and said spring means upon rotation of said code wheel assembly in an opposite sense being operative to release said pivotal pawl from contacting relation with said stop member so as to render said pawl ineffective to actuate the auxiliary code post locking means.

45. For use with a pair of electrical circuits which may be energized one circuit at a time in any sequential order, an apparatus for determining whether said circuits are energized in a predetermined order, said apparatus comprising a base member, a shaft supported by the base member, a code wheel supported by the shaft and including a plurality of selectively operable main code posts, actuatable means carried by the base member to selectively operate said main code posts for storing said predetermined order therein, means defining a start position for said code wheel, spring means for biasing said code wheel toward said start position, a ratchet wheel operatively connected to said code wheel, pawl means, motor means electrically operated by said circuits for operating said pawl means, said pawl means being normally in an operative relation with said ratchet wheel to effect step actuation of said code wheel in a direction opposed to said spring means, a plurality of auxiliary code posts carried by the code wheel and selectively operable by said motor means upon the actuation of said main code posts being in said predetermined order, means for releasably locking the main and auxiliary code posts in the actuated senses, reset means for releasing said main and auxiliary code post locking means, said reset means including first means operable within a first predetermined range of reverse rotation of the code wheel assembly under the biasing force of said spring means to release said auxiliary code post locking means, and other means operable within a second predetermined range of the reverse rotation of the code wheel assembly to release said main code post locking means.

* * * * *